US006412227B1

(12) United States Patent
De Zen

(10) Patent No.: US 6,412,227 B1
(45) Date of Patent: Jul. 2, 2002

(54) COMPOSITE DOOR FRAMES

(75) Inventor: Vic De Zen, Woodbridge (CA)

(73) Assignee: Royal Group Technologies Limited, Woodbridge ( * ) Notice: Subject to any disclaimer, the term of this patent is extended or adjusted under 35 U.S.C. 154(b) by 0 days.

(21) Appl. No.: 09/508,002

(22) PCT Filed: Aug. 26, 1998

(86) PCT No.: PCT/CA98/00812

§ 371 (c)(1),
(2), (4) Date: Mar. 7, 2000

(87) PCT Pub. No.: WO99/13191

PCT Pub. Date: Mar. 18, 1999

(30) Foreign Application Priority Data

Sep. 8, 1997 (CA) ..... 2214734

(51) Int. Cl.[7] ..... E06B 1/04
(52) U.S. Cl. ..... 49/504; 49/DIG. 2; 52/213
(58) Field of Search ..... 52/211, 213; 49/501, 49/504, 505, DIG. 2

(56) References Cited

U.S. PATENT DOCUMENTS

| | | | | |
|---|---|---|---|---|
| 1,606,780 A | | 11/1926 | Zahner et al. | |
| 3,287,856 A | | 11/1966 | Passovoy | |
| 3,886,688 A | * | 6/1975 | Ragland | 49/504 |
| 4,154,034 A | | 5/1979 | Bursk | |
| 4,281,481 A | | 8/1981 | Wendt | |
| 4,531,337 A | | 7/1985 | Holdman | |
| 4,631,866 A | | 12/1986 | Ott et al. | |
| 4,740,405 A | * | 4/1988 | Tanaka et al. | 428/45 |
| 4,870,791 A | * | 10/1989 | Nelson | 52/217 |
| 5,038,538 A | * | 8/1991 | Rozon | 52/213 |
| 5,081,793 A | * | 1/1992 | Mauro | 49/501 |
| 5,293,723 A | | 3/1994 | Slessok | |
| 5,345,722 A | * | 9/1994 | McKann | 49/505 |
| 5,497,594 A | * | 3/1996 | Giuseppe et al. | 52/730.4 |
| 5,572,840 A | * | 11/1996 | Fast et al. | 52/213 |
| 5,603,191 A | * | 2/1997 | Wu | 52/204.1 |
| 5,651,223 A | * | 7/1997 | Novak et al. | 52/211 |
| 6,138,413 A | * | 10/2000 | Fehr | 49/382 |

FOREIGN PATENT DOCUMENTS

| | | |
|---|---|---|
| DE | 92 05 318 U | 6/1992 |
| DE | 44 10 576 A1 | 11/1995 |
| DE | 195 30 270 A1 | 2/1997 |
| EP | 0 586 213 A1 | 3/1994 |
| GB | 542 914 A | 2/1942 |
| GB | 1 375 961 | 12/1974 |
| GB | 2 135 375 A | 8/1984 |
| LU | 50913 | 6/1966 |
| WO | WO 93/19272 | 9/1993 |

* cited by examiner

*Primary Examiner*—Curtis A Cohen

(57) ABSTRACT

A frame assembly (1) for mounting doors and the like comprising a pair of jambs (2, 3) and a header (4) for connecting said jambs, and, where required, a sill, each said jambs and header and sill (5) where required being a compression molding of filler, waste, or recycled particulate material bound together by a thermoplastic binder, each said jambs (2, 3) and header (4) presenting when assembled an inwardly facing planar surface of a width to receive a door to be mounted in said frame assembly and an inwardly projecting door stop shoulder formation projecting inwardly of said planar surface.

28 Claims, 20 Drawing Sheets

79
83
83
80

80
82
81
84
83
79
82
84
81
84
81
82
80

COMPOSITE DOOR FRAMES

FIELD OF THE INVENTION

This invention relates to frames for doors and to the frame members from which said frames are assembled.

BACKGROUND OF THE INVENTION

At present, the majority of door frames are made of wood and include a pair of jamb members and a header. If it is an outside door, the door frame also includes a door sill while in the case of inside doors the jambs extend to the floor.

Where large volumes are involved, the door frame members can be manufactured at a factory ready to be assembled on the job site or, in some instances, at the factory. Frequently, however, the door frame members are cut from lumber on the job site and drilled and routed out to provide for keepers and hinge mounting areas and then fitted into position for each individual door.

In addition to wood, there are door frames of other material or of other material along with wood.

U.S. Pat. No. 1,606,780, issued Nov. 16, 1926, discloses a metal door frame.

U.S. Pat. No. 4,281,481, issued Aug. 4, 1981, discloses an aluminum door frame while U.S. Pat. No. 3,287,856, issued Oct. 16, 1964, discloses an extruded metal frame.

U.S. Pat. No. 4,531,337, issued Jul. 30, 1985, discloses a combination metal and wood door frame while U.S. Pat. No. 4,505,080, issued Mar. 19, 1985, discloses a combination door frame of extruded metal or plastic and wood while U.S. Pat. No. 5,293,723, issued Mar. 15, 1994, discloses a combination of plastic and wood door frame.

In the case of wood door frames not only is wood relatively expensive but the wood members from which the frame is made are subject to twisting and warping adversely affecting the accuracy of the frame.

The metal frames on the other hand do not lend themselves to adjustment in the field to meet the circumstances of the frame receiving openings in the wall. Moreover, they are expensive and also usually involve assembly with some wood. Moreover, the metal is a good conductor of heat and is therefore a poor insulator.

Extruded plastic frame members do not have the inherent strength or wood and are not readily secured without the use of wood inserts.

ACKNOWLEDGEMENT OF PRIOR ART

European Patent Application 0-586213 A1, published Sep. 3, 1994, discloses a hollow window or door structural component which can be extruded or injection molded from a polymer and wood fiber. However, being extrudable, the walls of the hollow component have uniform dimensions throughout their length and the component is open at the ends. Such components can be joined at right angles by diagonally cutting and welding the ends thereof but provide no interfitting seating arrangements.

U.S. Pat. No. 4,154,034, issued May 15, 1979, discloses door frame. components of generally J-shape cross-section molded from fiber glass reinforced polystyrene. However such components rely on the upturned tip of the lower part of the J as a door stop and use the back of the J for mounting metal strips for attaching the component to the studding.

SUMMARY OF THE INVENTION

The present invention is directed to providing a door frame which is very much cheaper than existing door frames, exhibits all the advantages of solid wood frames for workability and insulation but which is stronger, impervious to the elements and insects and will not splinter, crack, warp, corrode or rust, nor require the maintenance involved with wood frames.

According to the invention, the door frame is formed from components of compression molded composite material molded into accurate profiles ready for quick, easy and accurate assembly.

More particularly, according to the invention the frame components are compression moldings of filler, waste, or recycled particles or small pieces (hereinafter "particulate material") bonded together by a thermoplastic material which can be a waste or recycled thermoplastic.

Such compression molded components according to the preferred form of the invention are formed to provide interengaging locating means to ensure that they are brought together in precisely accurate registration ready for securement by appropriate fasteners.

In this connection, by providing for precise component assembly interengagement a minimum number of fasteners is required to secure the frame members in assembled relation enabling the door frame to be quickly, easily and accurately assembled.

Being molded, the invention enables the jamb and header frame members to be formed as elongated channels or boxes suitably internally reinforced which present stepped bottom surfaces to be presented facing inwardly of the door receiving opening to be framed by the door frame. Such in effect hollowed outdoor frame members thus require a minimum of material creating members of light weight for ease of handling and installation.

Further, by compression molding the frame members, they can be formed to provide integral bored pods, protuberances or thickened areas to receive, support and accommodate the passage of screws or the like therethrough to secure the frame members to the door frame opening.

Moreover, by forming the door frame elements in the molding or other operation provision can be made to accurately locate the hinge and striker plate mounting areas and to provide appropriately located internal reinforcing hollowed out pods or blocks of material to accept the insertion of the latching and bolting hardware of a door.

Also, according to the invention, the jambs and header members can be molded to produce a precisely accurate integral molding to meet the brick work (sometimes refined to a brick molding) when the door frame is for an outside door.

Where it is desired to employ a separate brick molding according to the invention, there is provided an elongated compression molded channel member with bevelled ends and transverse webs including webs running angularly or obliquely across between the walls of the channel and webs running perpendicularly across between the channel walls whereby the molding may be cut at appropriate locations to form bevelled ended header moldings of varying length depending on the door width and jamb moldings having bevelled upper ends either for a left hand or right hand door jamb.

Further according to the invention, the door frame sill where required is formed as a molded composite structure with a repeating internal pattern so that it can be cut at appropriate points to fit the width of door which the door frame is to receive.

These and other features of the invention will be apparent from the following detailed description taken in conjunction with the accompanying drawings.

DETAILED DESCRIPTION ACCORDING TO THE PREFERRED EMBODIMENTS OF THE PRESENT INVENTION

Figure 1:
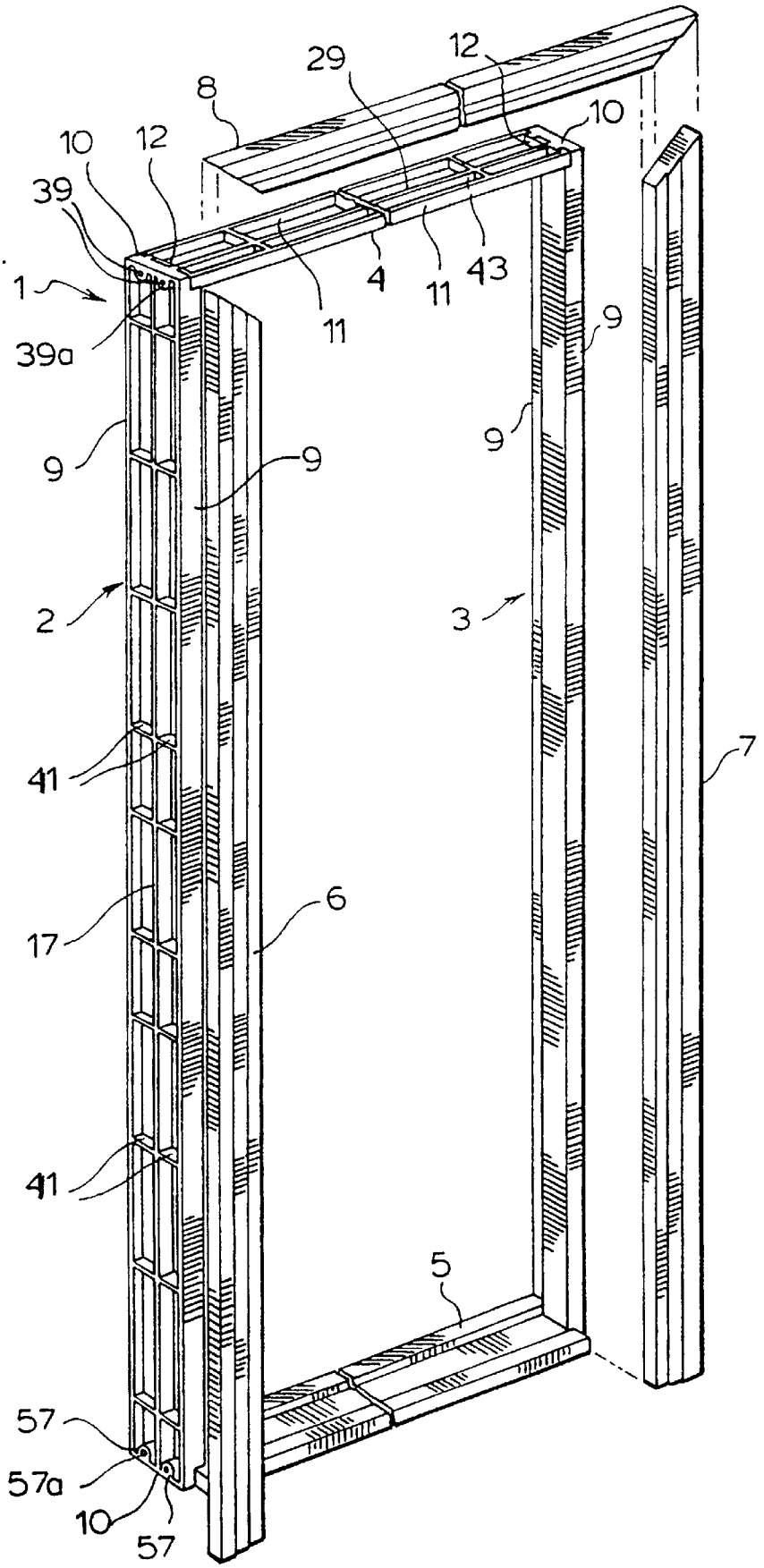
FIG. 1 is a perspective view illustrating a molded door frame for an in swing door with a separate trim or brick molding in accordance with the invention.

With reference to FIG. 1, there is shown a door frame generally designated at 1 comprising a left hand jamb 2, a right hand jamb 3, a header 4, and a sill 5.

Also in FIG. 1 there is shown a separate trim or brick molding for attachment to the frame 1 comprising a left hand molding jamb 6, a right hand molding jamb 7, and a molding header 8.

Each of the door frame jambs 2 and 3, header 4, and sill 5 are formed of synthetic material comprising compression moldings of filler, waste, or recycled particulate material bonded together by a thermoplastic binder which advantageously is a waste or a recycled thermoplastic. Similarly, each of the molding members 6, 7 and 8 are also compression moldings of similar synthetic material.

The particulate material to be used in the door frame members is selected to provide the requisite properties such as temperature stability, strength, and hardness.

Where the door frame is to be exposed to substantial temperature changes, the particulate filler, waste, or recycled material preferably comprises at least in part a fibrous material such as wood flour, saw dust, shredded and/or ground waste cloth or paper. The thermoplastic binding material may comprise, for example, recycled PVC or polyethylene and the ratio by weight would preferably be about 30% to about 60% to 70% particulate material with the balance being the thermoplastic binder material, or principally thermoplastic binder material together, if desired, with some additional particulate material such as fly ash or kiln dust to impart hardness and strength. For example, as quantities of sawdust are usually readily available, a particularly usual composite material for external door frames exposed to wide temperature ranges comprises approximately 50% sawdust and 50% recycled polyethylene. It will be understood, however, that the percentage and nature of the filler, waste or recycled particulate material and the thermoplastic material can vary widely depending on the door frame requirements and there may be certain instances where the ratio of particulate material to thermoplastic material can be as high as 90% to 10% and vice versa.

With respect to the thermoplastic material, the recycled polyethylene may be reground low, medium or high density polyethylene. Other examples of useful recycled thermoplastics comprise reground polypropylene, polyethylene terephthalate (PET), nylon, and ABS.

Other examples of filler waste or recycled particulate materials to be bonded together by the thermoplastic binder can include, for example, without limiting the same, glass fibers or particles, reground thermosetting materials, ground shells such as peanut shells and husks such as rice and corn husks, ground particles of rubber or metal or other hard material.

In molding the door frame components, preferably the particulate filler waste or recycled material and the recycled plastic material are introduced into the compression mold as an intimate mixture of hot particulate material having its particles coated with molten thermoplastic material whereupon under compression forces in the compression molding operation the molten thermoplastic material encapsulates and bonds the coated particles into a strong compacted bonded mat.

Each of the jambs 2 and 3 and the header 4 are molded to form an elongated box like structure. The jambs have elongated side walls 9 and end walls 10 with the header 4 having elongated side walls 11 and end walls 12.

Standard doors are 79 inches tall and come in widths typically varying from 30 inches to 42 inches with the majority of doors being either 32 or 36 inches in width. However, it will be understood that the door heights may vary, some doors being for example 96 inches tall, and the width of double doors will of course be substantially greater than 42 inches.

As a result, it will be appreciated that the jambs 2 and 3 have to have a length to accommodate the height of the doors while the length of the header will vary to accommodate the different widths of doors.

Figure 2:
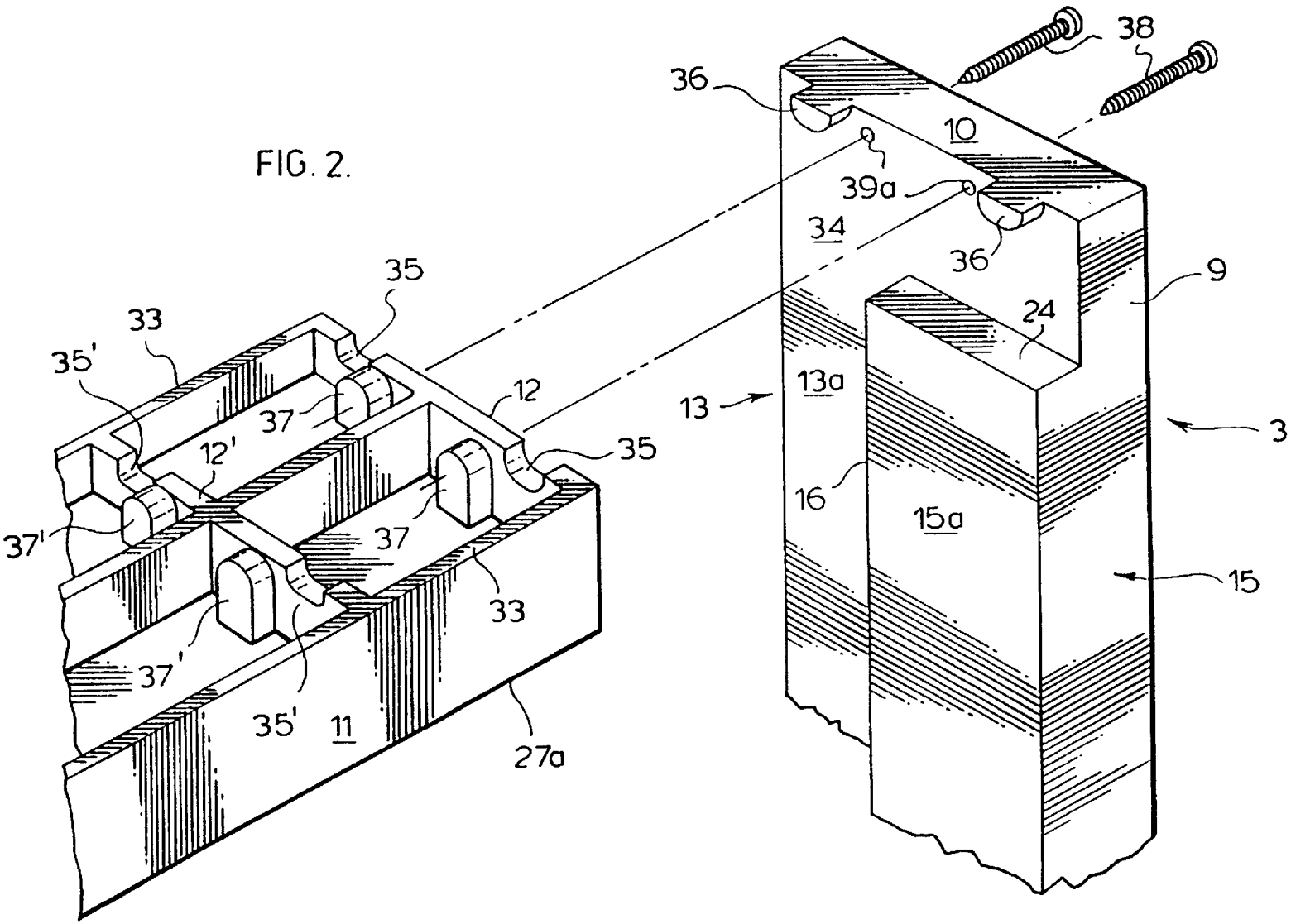
FIG. 2 is an enlarged perspective view illustrating the connection of the top of one of the jambs of the frame of FIG. 1 with the header.
Figure 3:
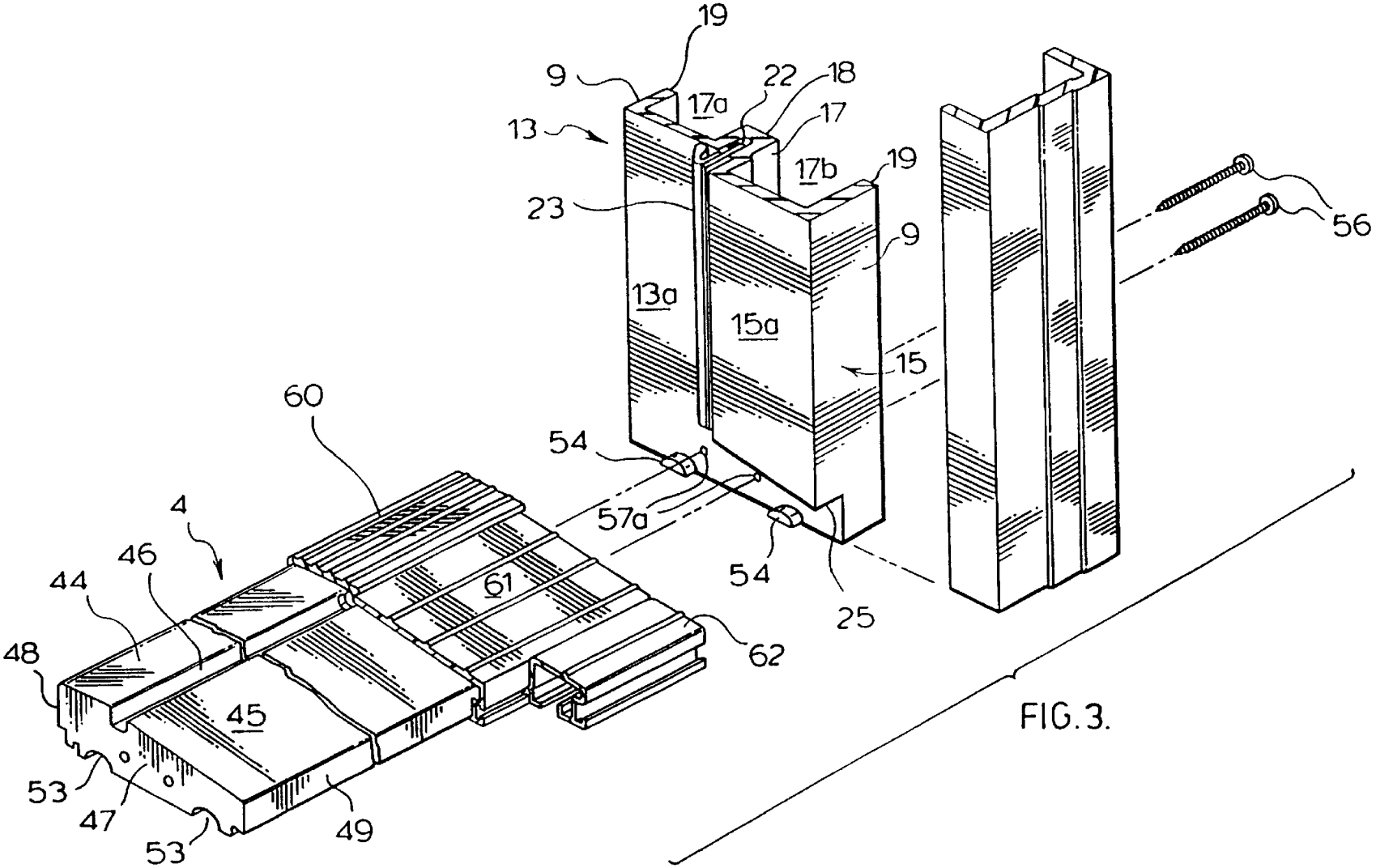
FIG. 3 is a perspective view illustrating how the bottom of one of the jambs is connected to the sill and showing the jamb of the trim or brick molding in position to be connected to the jamb of the frame.
Figure 4:
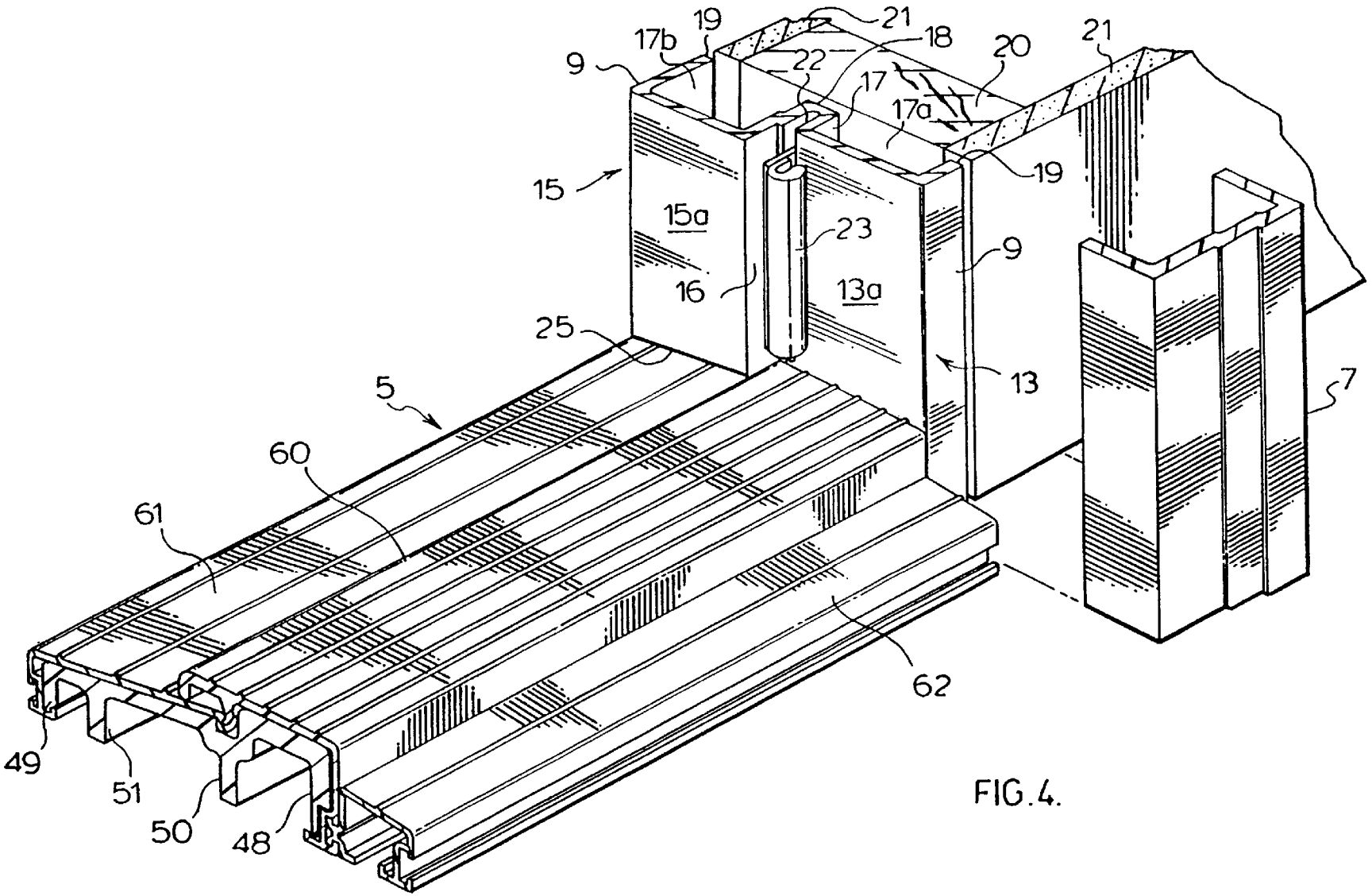
FIG. 4 is a view similar to FIG. 3 but showing an out swing door.
Figure 5:
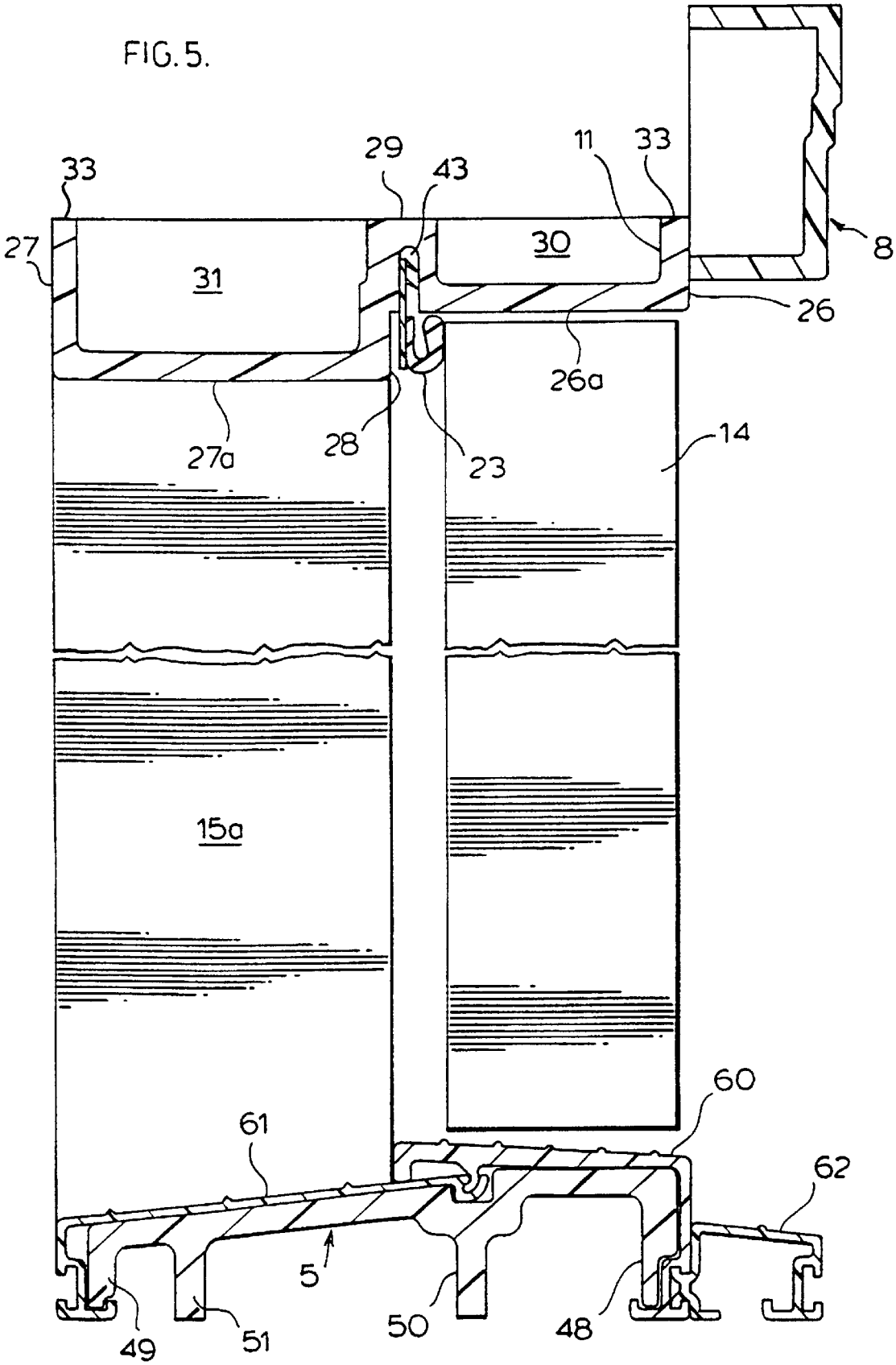
FIG. 5 is a vertical section through the door frame with the separate trim or brick molding attached.

As shown in FIGS. 2, 3 and 4, the box like structures of each of the jambs 2 and 3 is formed with a stepped bottom to be presented facing inwardly of a door receiving opening to be framed by the door frame and comprising a first step 13 presenting a first longitudinally extending exterior bottom planar surface 13*a* of a width to receive the thickness of the edge of a door such as the door 14 shown in FIG. 5 to be mounted in the frame.

Extending along side of the first step 13 and projecting inwardly beyond its planar surface 13*a* is a second step 15 presenting a second longitudinal extending planar bottom surface 15*a*. The juncture between steps 13 and 15 defines a door stop shoulder 16.

The interior of each of said jambs 2 and 3 is divided intermediate its width in line with the juncture of the first and second steps 13 and 15 by a longitudinally extending wall 17 which in effect divides the interior of the jambs into two adjoining channels 17*a* and 17*b* with channel 17*a* being shallower than channel 17*b*. The edge 18 of wall 17 terminates in the same plane as the edges 19 of the walls 9 and 10 of the jambs. The arrangement is such that when mounting the jambs 2 or 3 in the wall opening of the building as illustrated in FIG. 4 the edges 18 and 19 will abut the framing of the building wall opening constituted for example by the two by four 20 and wall sheeting or partitions 21.

The stepped bottom of each of the jambs 2 and 3 is formed with a groove 22 at the juncture of the steps 13 and 15 with this groove 22 extending into the longitudinally extending wall 17 and being adapted for the mounting therein of resiliently flexible weatherstripping 23 for a purpose as will hereinafter be more fully described.

The inwardly projecting second step 15 of the jambs is shown as terminating short of the jamb end walls 10. As illustrated particularly in FIG. 2, the upper end of step 15 terminates in a flat ledge 24 which is adapted to form a locating seat for the header 4 as hereinafter more fully described.

Similarly, the lower end of the step 15 ends short of the lower end of the jamb in a slightly inclined ledge 25 adapted to seat on the sill 5 as hereinafter more fully described.

As shown in FIG. 5, the molded header 4, like the jambs 2 and 3, preferably has a stepped bottom surface which, when the header is installed, faces inwardly of the door frame opening said stepped header bottom comprising a first step 26 presenting longitudinally extending planar exterior bottom surface 26*a* of a width to receive the edge of a door to be mounted in the door frame and a second step 27 presenting longitudinally extending planar exterior bottom surface 27*a* said step 27 projecting inwardly beyond the surface 26*a* to provide a door stop shoulder 28 as shown in FIG. 5.

A longitudinal wall 29 registering with the juncture of the steps 26 and 27 divides the interior of the header intermediate its width into a pair of adjoining channels 30 and 31 with the channel 30 being shallower than the channel 31.

It will be understood that the edge 32 of the wall 29 will be in the same plane as the edges 33 of the walls 11 and 12 of the header for mounting in the door frame receiving opening of the wall in which the door frame and door is to be mounted as illustrated in FIG. 4.

In the arrangement shown, particularly in FIG. 2, the length of the header steps 26 and 27 and the header channels 30 and 31 are the same so that the end wall 12 at each end of the header will contact the face area 34 of the respective jamb above the jamb ledge 24 with the bottom surface 27*a* of the header step 27 resting on the ledge 24.

As illustrated in FIG. 2, the end wall 12 of the header is provided with spaced generally semi-circular notches 35 while the jamb 3 is shown with integral pegs or protuberances 36 which fit into the notches 35 to ensure proper registered assembly between the header and the jamb with the header seated on the jamb ledge 24.

The interior of the header end wall 12 is provided with integral protuberances 37 to provide a body of material having a depth to receive and provide adequate holding power for the screws 38 which pass through the jamb and into the end of the header and into the protuberances 37 in the assembly of the header with the jamb.

The header can be cut transversely to fit different widths of doors or for use in side light frames as hereinafter explained by providing, as shown in FIG. 2, one or more internal transverse walls 12' provided with notches 35' corresponding to the notches 35 and with protuberances 37' corresponding to the notches 37.

It will be understood that the arrangement at one end of the header as illustrated in FIG. 2 will be duplicated at the other end in assembling the header to the jambs.

As shown in FIG. 1, the interior of the jamb 2 is provided with internal integral protuberances 39 extending out from the inner surface of the bottom wall to provide support for the screws 38 for the assembly of the jamb and header. Preferably these protuberances 39 are formed with passages or bores 39*a* extending therethrough, these bores being shown as emerging from the wall portion 40 above the ledges 24 of the right hand jamb 3 in FIG. 2, it being understood that the left and right hand jambs are identical with respect to the arrangement for registration and securement with the header.

The jambs 2 and 3 are preferably provided with transverse reinforcing webs 41 running between the longitudinal intermediate wall 17 and the side walls 9 of the jambs.

Similar webs 42 are provided in the header 4 running between the intermediate longitudinal header wall 29 and the header side walls 11.

As in the case of the jambs, the stepped bottom surface of the header 4 is provided with a groove 43 at the juncture of the steps 26 and 27 with this groove extending up into the intermediate wall 29 for the mounting of resilient flexible weather stripping 23.

By providing bores through the protuberances 39 with a diameter such that they snugly fit the screws 38, the jambs can be secured to the header without the turning of the screws backing off the jambs from the ends of the header.

Figure 6:
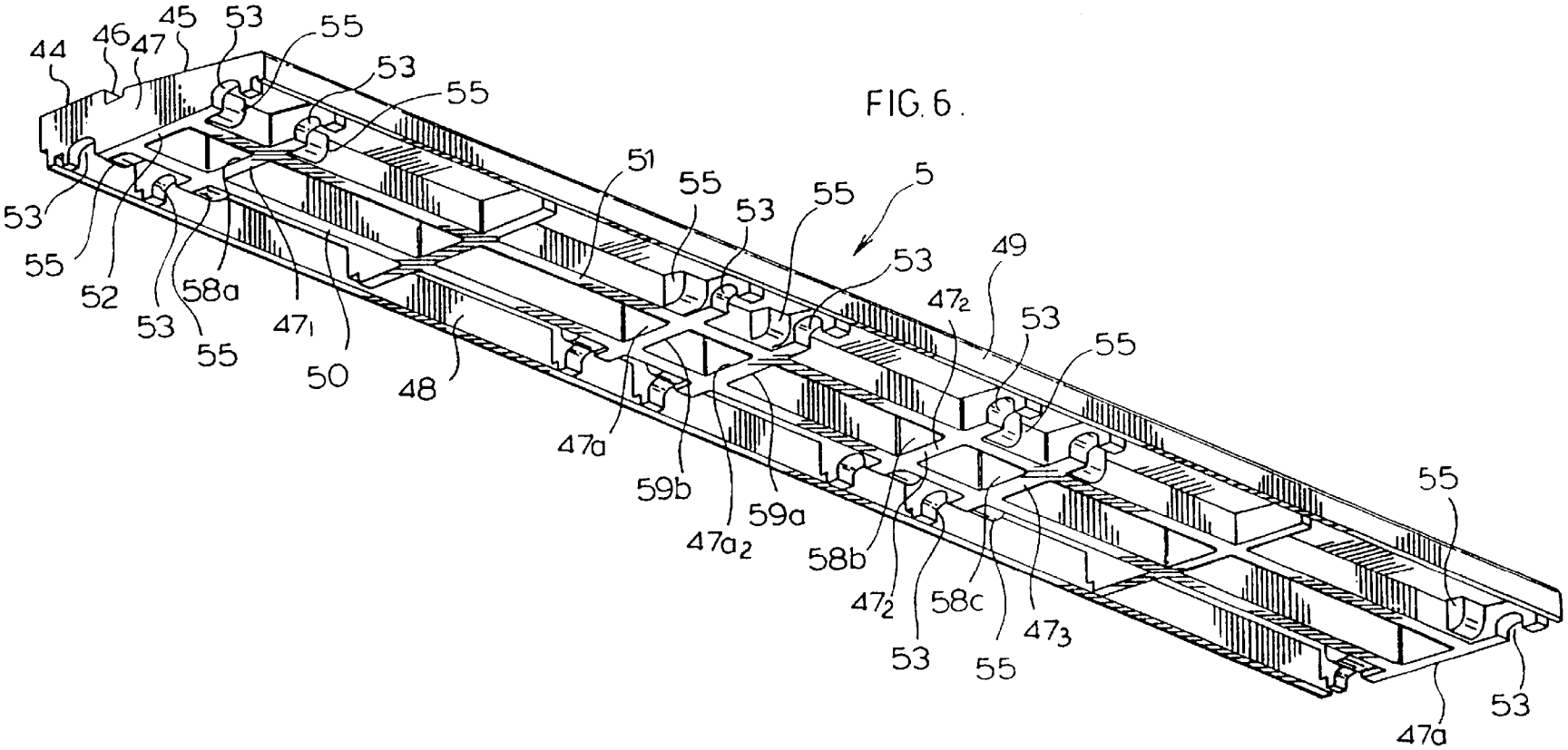
FIG. 6 is a perspective view of a molded sill in accordance with the invention which can be cut to suit different frame sizes to accommodate different widths of doors.

The sill 5 shown in FIGS. 3, 4, 5 and particularly FIG. 6 like the jambs 2 and 3 and the header 4 is formed by compression molding a composite material comprising filler, waste or recycled particulate material and a thermoplastic binder as set out above.

As shown in FIG. 6, the sill is preferably formed as an elongated member to cover the full range of door widths or sizes, being adapted to be cut at various points corresponding to the width of the door the door frame is intended to receive.

As shown in FIG. 6, in its elongated form, the top of the sill comprises a narrow horizontal portion 44 running the length of the sill and a wider sloping portion 45 separated by a longitudinal groove 46.

Spanning between end walls 47 and 47*a* of the sill are outer walls or legs 48 and 49 and intermediate legs 50 and 51 all of which legs terminate in a common plane with the bottom edges 52 of the end walls 47 and 47*a*.

The end walls 47 and 47*a* are provided with notches 53 to receive correspondingly shaped pegs or projections 54 provided at the bottom of the jambs 2 and 3 as illustrated in FIG. 3.

On the inside of the end walls 47 and 47*a* of the sill, there are provided integral inwardly projecting protuberances 55 to provide a depth of material to be engaged by and provide holding power for fasteners or screws 56 used to assemble the jambs to the sill as illustrated in FIG. 3.

By the provision of the projections 54 on the jambs and the notches 53 in the sill end walls 47 and 47*a,* proper registration can be obtained between the jambs and the sill prior to securing the members together.

The jambs 2 and 3 are also provided with interior projections 57 as indicated in FIG. 1 to provide support for the fasteners 56 and again these projections are formed with bores 57*a* to snugly receive the fasteners 56 so that when screws are used the turning of the screws will not back off the lower end of the jambs as the screws penetrate the material of the sill projections 55.

As illustrated in FIG. 6, the end walls 47 and 47*a* are in essence duplicated at points along the length of the sill member shown in FIG. 6 to provide for the sills of different widths of doors or a sill for a door with a side light as hereinafter more fully explained. Thus by cutting the sill of FIG. 6 at the outside of the walls 58*a,* 58*b,* and 58*c* end walls $\mathbf{47}_1$, $\mathbf{47}_2$, and $\mathbf{47}_3$ will be provided complete with notches 53 and projections 55.

Similarly, if the elongated sill of FIG. 6 is cut at the outside of walls 59*a* and 59*b,* the right hand end wall 47*a* will be duplicated as end walls $\mathbf{47}a_1$ and $\mathbf{47}a_2$ complete with notches 53 and projections 55.

When installed, the sill 5 preferably has its wider sloping surface 45 covered with an aluminum extrusion 60 and its top horizontal surface 44 covered with a vinyl extrusion 61 arranged to interengage in the longitudinal groove 46.

An additional protective aluminum extrusion 62 is arranged to interlock with either the aluminum extrusion 60 in an in swinging door or the vinyl extrusion 61 in an out swinging door.

In assembling the door jambs 2 and 3 to the ends of the header 4. only two screws for each jamb is required these screws passing through the bored jamb protuberances 39 and into the header protuberance 37. Similarly, only two screws for each jamb is required to secure the jamb to sill 5, the screws passing through the bored jamb projections or protuberances 57 and into the sill protuberances 55. Thus the entire door frame can be assembled with only eight screws.

Figure 8:
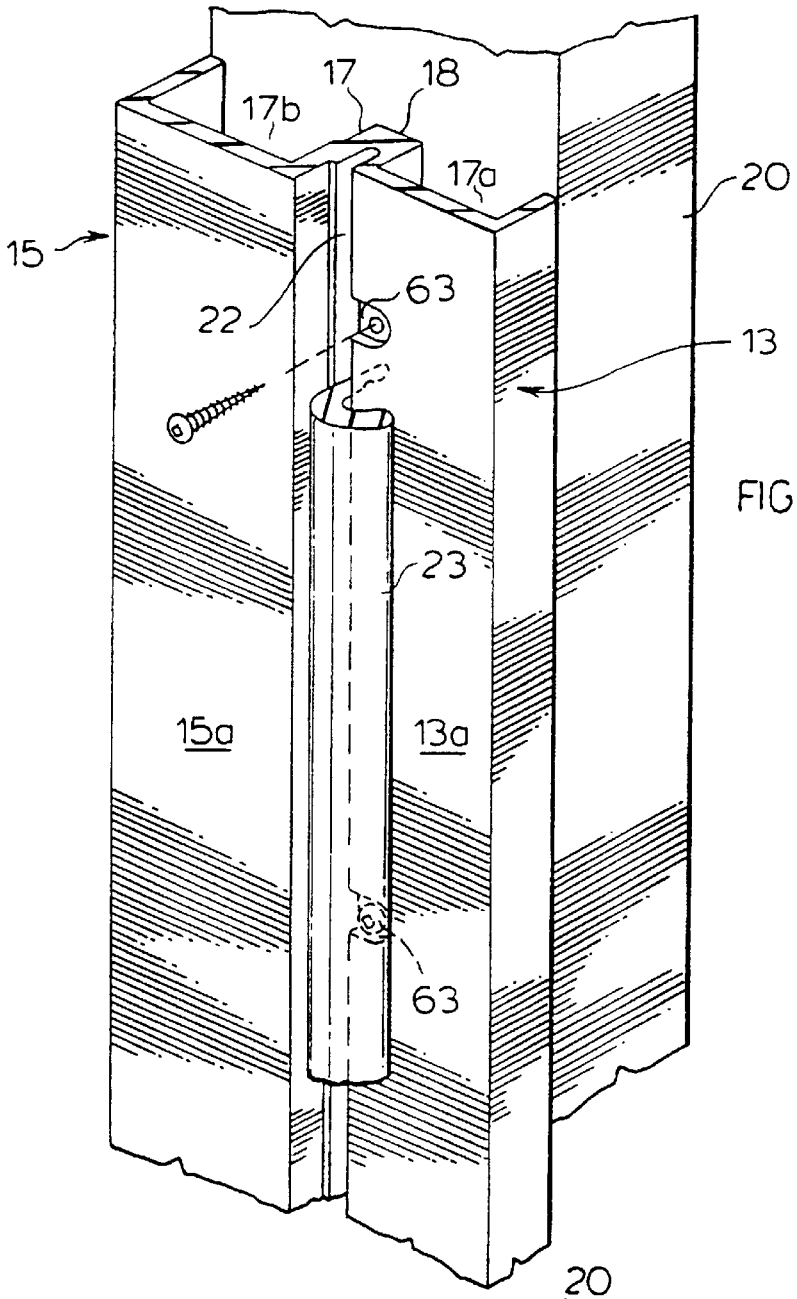
FIG. 8 is a perspective view of one of the jambs of the door frame showing how it is attached to the door receiving opening in a building wall.
Figure 9:
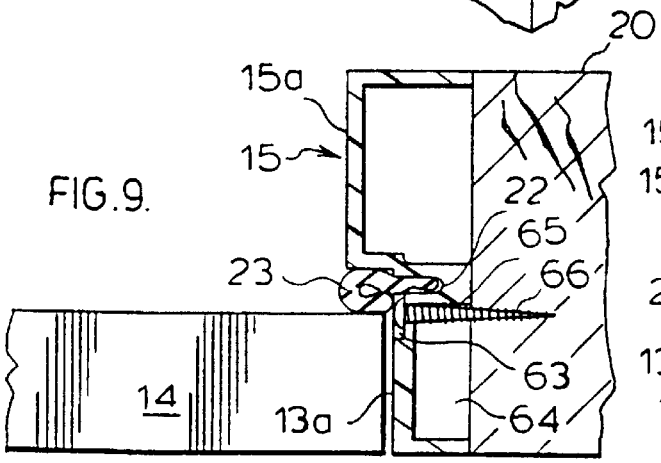
FIG. 9 is a horizontal sectional detail of the jamb and wall structure of FIG. 8 showing a door in place displacing the resilient flexible weather strip used to hide the attachment screws when the door is open, one screw only being illustrated.
Figure 10:
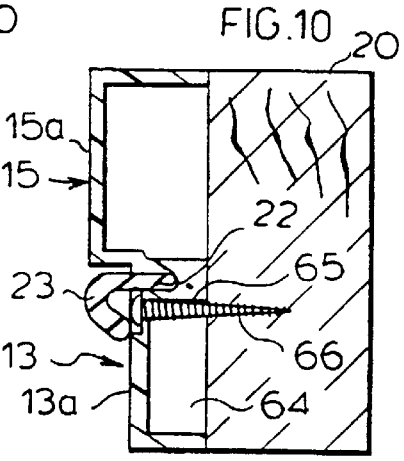
FIG. 10 is a view similar to FIG. 9 but with the door open showing the resilient flexible weather stripping now covering and hiding the attachment screw.

With respect to the fastening of the jambs 2 and 3 of the assembled door frame, to the opening in the wall to receive the door frame, reference is had to FIGS. 8, 9 and 10. As illustrated in FIG. 8, the inwardly facing planar bottom surface 13*a* of the jamb step 13 is recessed as at 63 at intervals along its length. As shown in FIGS. 9 and 10, the interior of the jamb behind the recessed area 63 has a solid column of material 64 extending the depth of the step 13 and this solid column 64 is formed with a bore 65 extending therethrough of a diameter to snugly receive the fasteners or screws 66 so that when the jamb is mounted against the door frame receiving opening frame member 20 then the turning of the screw 66 to penetrate the frame member 20 to clamp the jamb to the frame member will not act to back off the jamb.

FIG. 9 illustrates the mounted jamb with the door 14 in the closed position compressing the flexible resilient weather stripping 23 which clears the head of the screw 66 which is seated down in the recess 63. However, the head of the screw will not be visible with the door 4 in the closed position.

FIG. 10 is a view similar to FIG. 9 but without the door 14 present and showing the flexible resilient weather stripping recovered to extend over the screw 66 hiding same from view with the door open.

It will be understood that in mounting the door 14 the door will be hinged to one of the jambs 2 or 3 and the other jamb will accommodate the striker plate door latch and door bolt where required.

Figure 11:
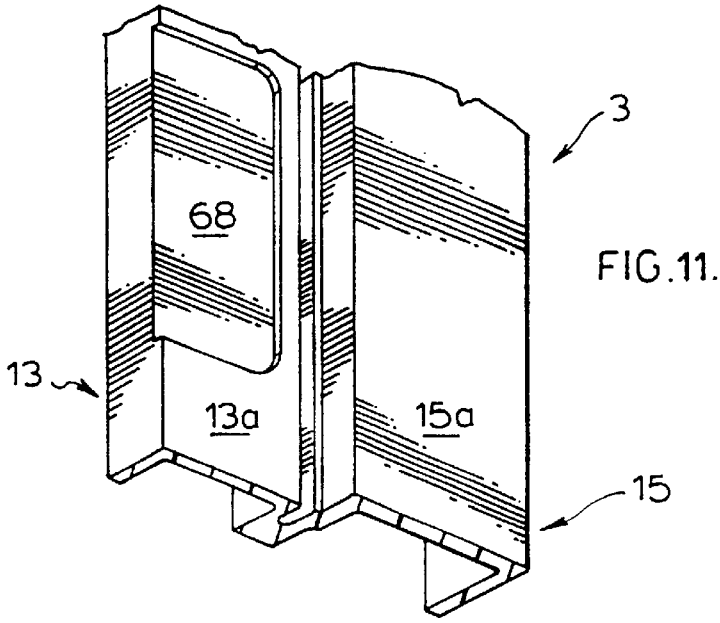
FIG. 11 is a perspective view of a section of the door jamb to which the door is to be hinged and showing one of the hinge receiving recesses.
Figure 12:
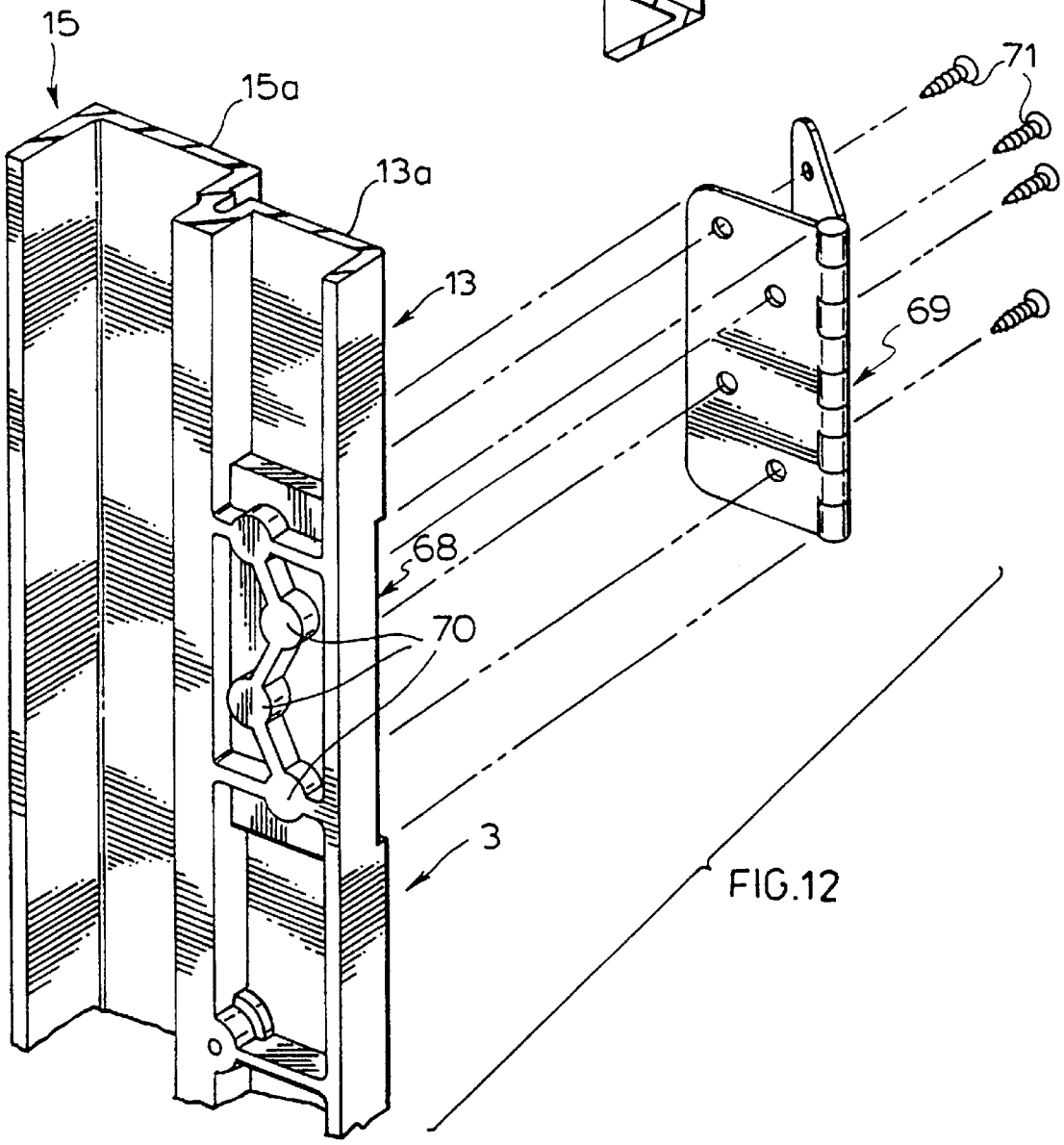
FIG. 12 is a perspective view taken from the rear of the jamb shown in FIG. 11 showing the arrangement of integral pods or protuberances formed with through passages or bores to receive the screws for attachment of the hinge to the door jamb.
Figure 14:
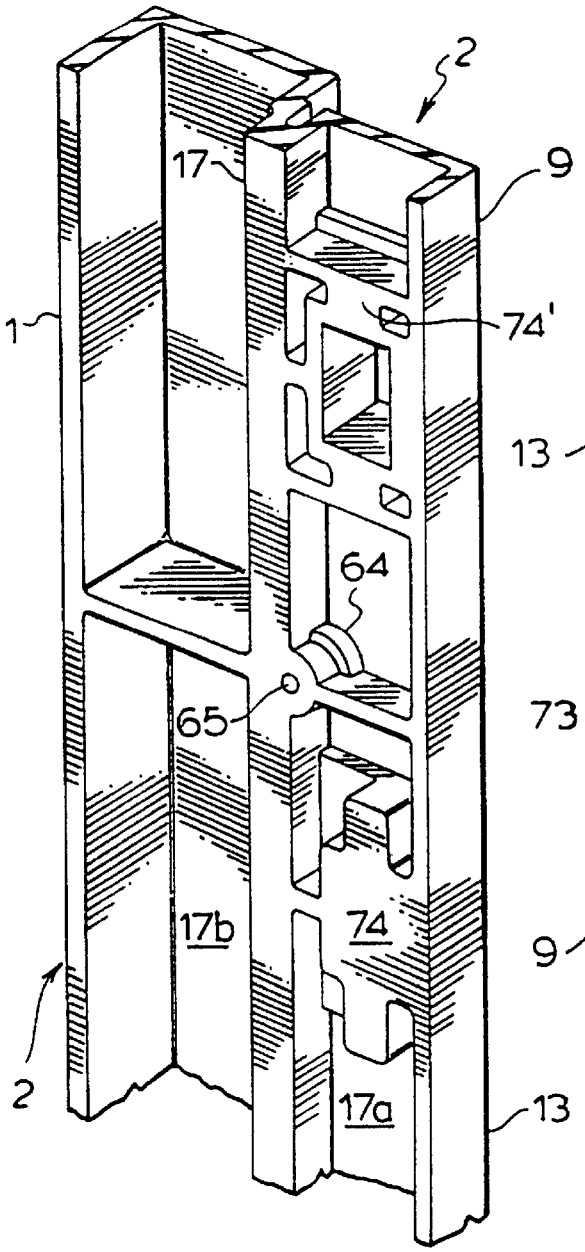
FIG. 14 is a perspective view of the jamb of FIG. 13 taken from the rear showing the molded reinforcing material blocks or pods for acceptance of the door latching mechanism and locking bolt.

FIGS. 11 and 12 illustrate, as an example, jamb 3 to which the door is to be hinged.

As shown in FIG. 11, the inwardly facing first bottom planar surface 13*a* of a step 13 is recessed as at 68 for flush mounting of one leaf of the hinge 69 shown in FIG. 12.

On the reverse side of the jamb behind the recessed area 68, the interior of the jamb is formed with a series of integral interconnected columns or projections 70 extending the depth of the step 13 to provide a body of material to receive the hinge screws or fasteners 71.

Figure 13:
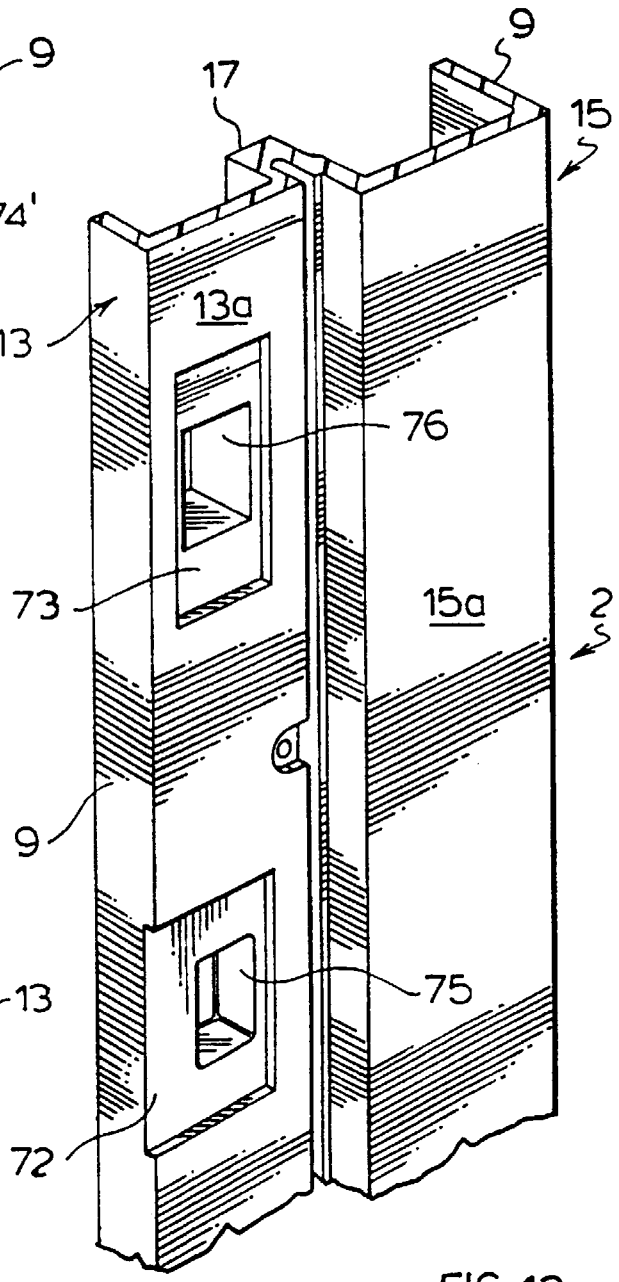
FIG. 13 is a perspective view of the jamb which is to receive the striker plate for the door and which incorporates the door latch and locking bolt recesses.

The planar surface 13*a* of the opposite jamb, i.e. jamb 2, is shown in FIG. 13 as being recessed at 72 to receive a striker plate, not shown, and also recessed as at 73 to receive a bolt plate, not shown.

Behind the striker plate recess 72 in the interior of the step 13 is an integral block of material 74 extending the depth of the step 13. The striker plate recess 72 is formed with a rectangular bore 75 projecting into the block 74 to provide an opening for the door latch.

Similarly, behind the bolt recess 73 is a block of material 74' with the bolt recessed area 73 being provided with a rectangular bore 76 extending through the integral block of material 74' to receive a latching bolt.

It will be understood that when viewing the in swing door of FIG. 1 from the outside of a building it will be the right hand jamb 3 which will be formed to receive the hinges, usually three hinges being employed. The left hand jamb will be formed to accommodate the door latch and door bolt where employed. However, it will be understood that the swinging of the door can be reversed in which case the left hand jamb will receive the hinges and the right hand jamb the door latch and bolt.

The role of these jambs will be reversed in the case of an out swing door.

To dress the door frame 1 of FIG. 1 the molding comprising the molding jambs 6 and 7 and the header 8 is provided. As mentioned, this molding is formed as a compression molding of composite material as described above. Since the molding members 6, 7 and 8 do not carry the load of the door, it will be understood that the nature of the particulate material and the percentage of particulate material and thermoplastic material may vary from that employed in molding the door frame itself.

Figure 7:
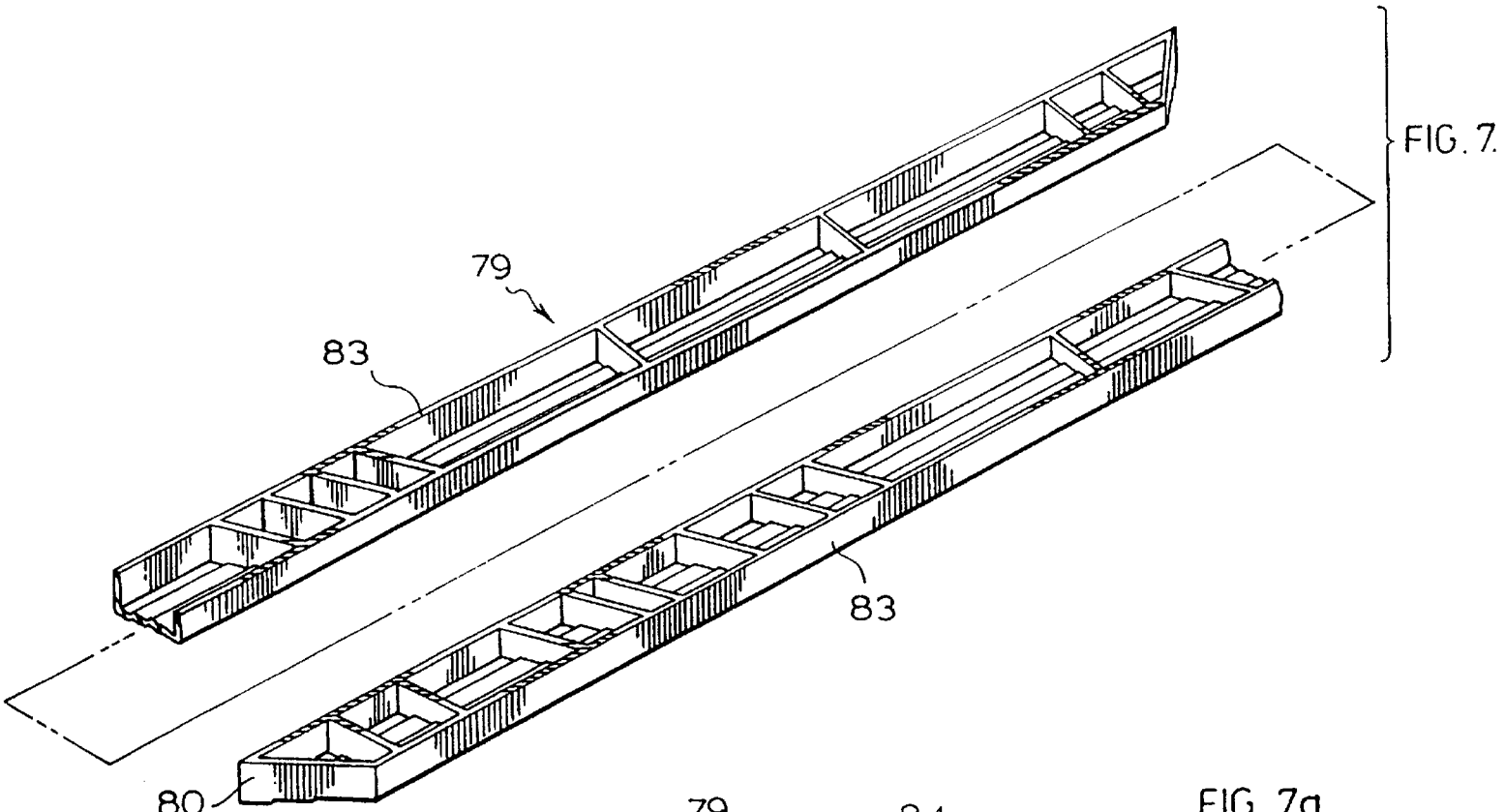
FIG. 7 is a perspective view of an elongated molded structure from which the jambs and headers of the separate trim or brick molding for the door frame can be formed.

These molding members 6, 7 and 8 may of course be individually molded or they can be conveniently obtained by appropriately cutting the elongated molding channel 79 shown in FIG. 7. This channel 79 is formed with beveled ends 80, a series of slanted internal webs 81, and right angular webs 82 extending between the side walls 83 of the channel. By cutting along the appropriate lines 84 coinciding with the slanted internal webs 81, the proper length of header 8 can be obtained to suit the door frame size required for the size of door selected or, if a door side light is used, the length necessary to frame the head of the door and door side light. It will be understood that the cutting will take place so that both ends of the header are beveled.

By cutting the molding 79 transversely at right angles to the said walls 83, the door jambs 6 and 7 can be formed.

When the header 8 and jambs 6 and 7 are attached to the frame 1 as by finishing nails for example, these frame members will form mitered top corners.

While preferably the jambs 2 and 3 are formed so that the door stop shoulders 16 presented by the second steps 15 are shorter than the door edge receiving surfaces 13*a* presented by the first steps 13 to provide mounting ledges 24 as shown in FIG. 2 and the door stop shoulder 28 presented by the second step 27 of the header 4 extends the full length of the header, this relationship may be reversed if desired. That is, the header second step 27 and hence door stop shoulder 28 can be formed to terminate short of both ends of the first step 26 of the header while the jamb stop shoulders 16 can continue to the tops of the jambs.

It will be understood in the case of inside doors where sills are not required, the jambs will extend down to rest on the floor.

FIGS. 15 to 18 illustrate a door frame generally designated at 85 which has jambs 86 and 87 and a header 88 which are identical with jambs 2, 3 and header 4 except that they have the moldings corresponding to the jamb molding 6 and 7 and the header molding 8 molded integral therewith. Because in all other respects the jambs 86 and 87 and the header 88 correspond to the jambs 2 and 3 and the header 4 like parts are given like numbers. The sill 5 remains unchanged.

Figure 15:
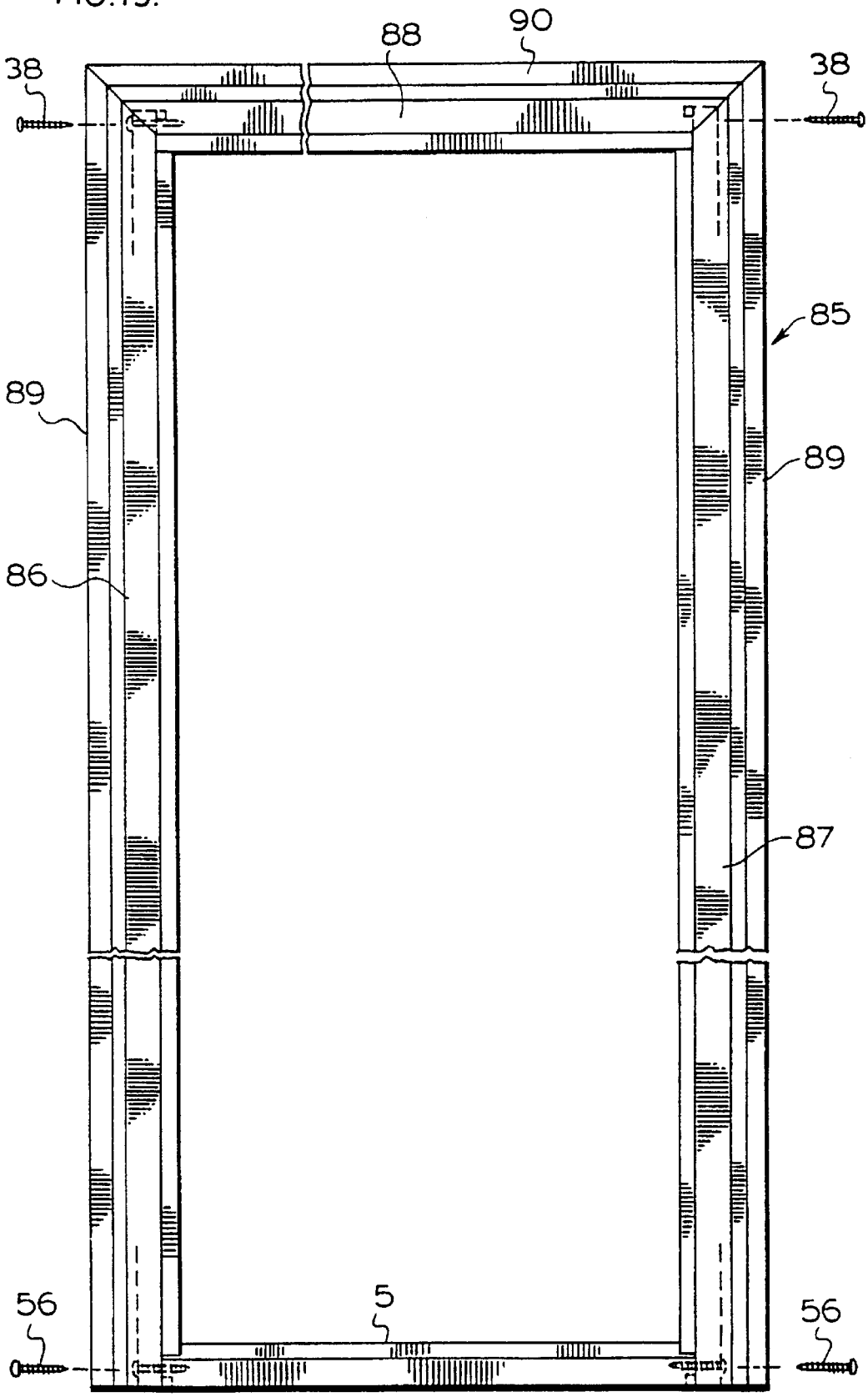
FIG. 15 is a front elevational view of a door frame in accordance with the invention in which the trim or brick molding is molded integrally with the door frame jambs and header.
Figure 16:
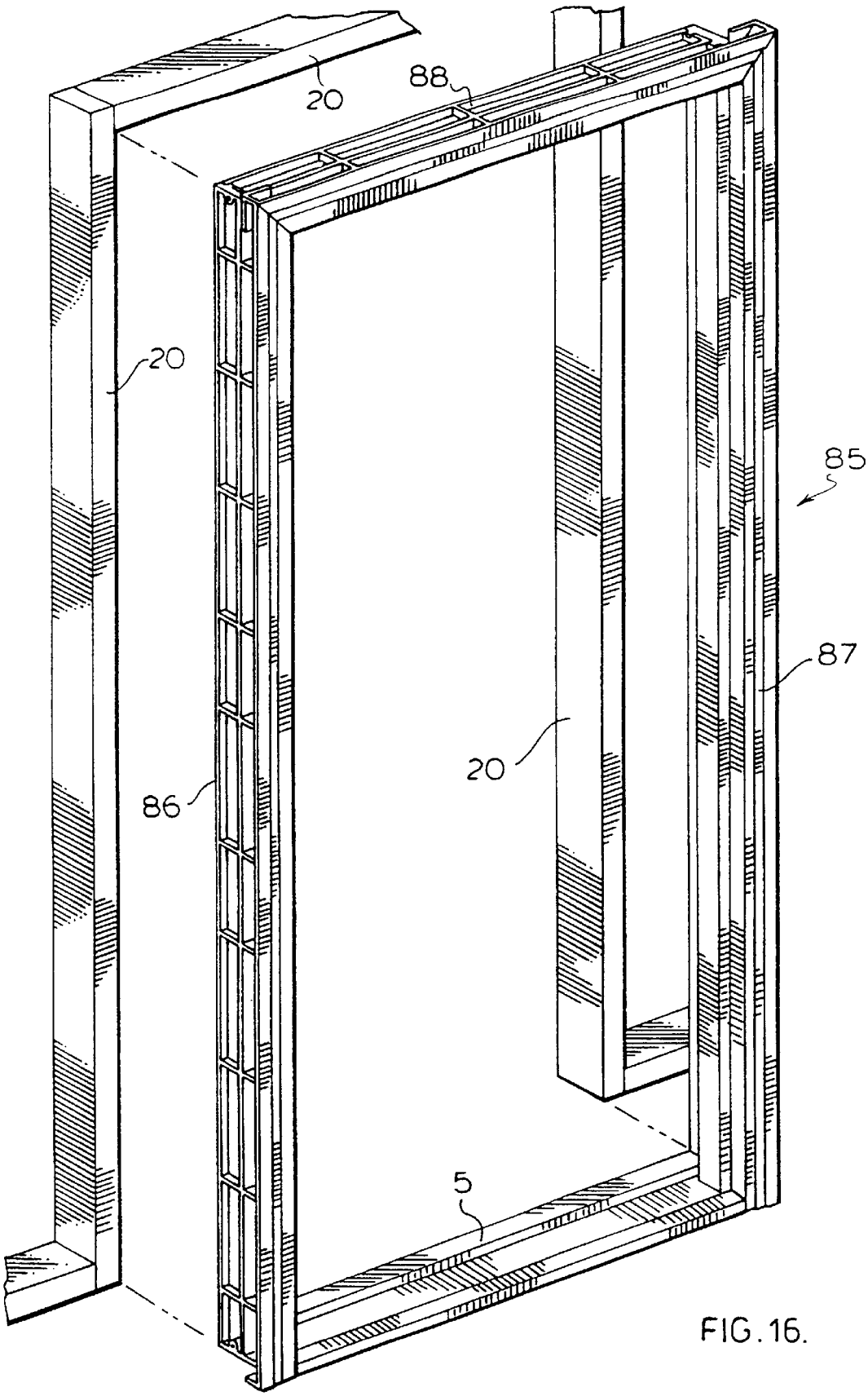
FIG. 16 is a perspective view of the door frame of FIG. 15 ready to be inserted into the door receiving opening of a wall.

FIG. 15 shows the door frame 85 with the jambs with their integral moldings 89, the header with its integral molding 90 and the sill 5 assembled ready for introduction into the frame receiving opening of a wall. FIG. 16 illustrates the assembled door frame 85 about to be mounted in the wall opening to be attached to the receiving frame members 20 which may for instance be two by fours.

Figure 17:
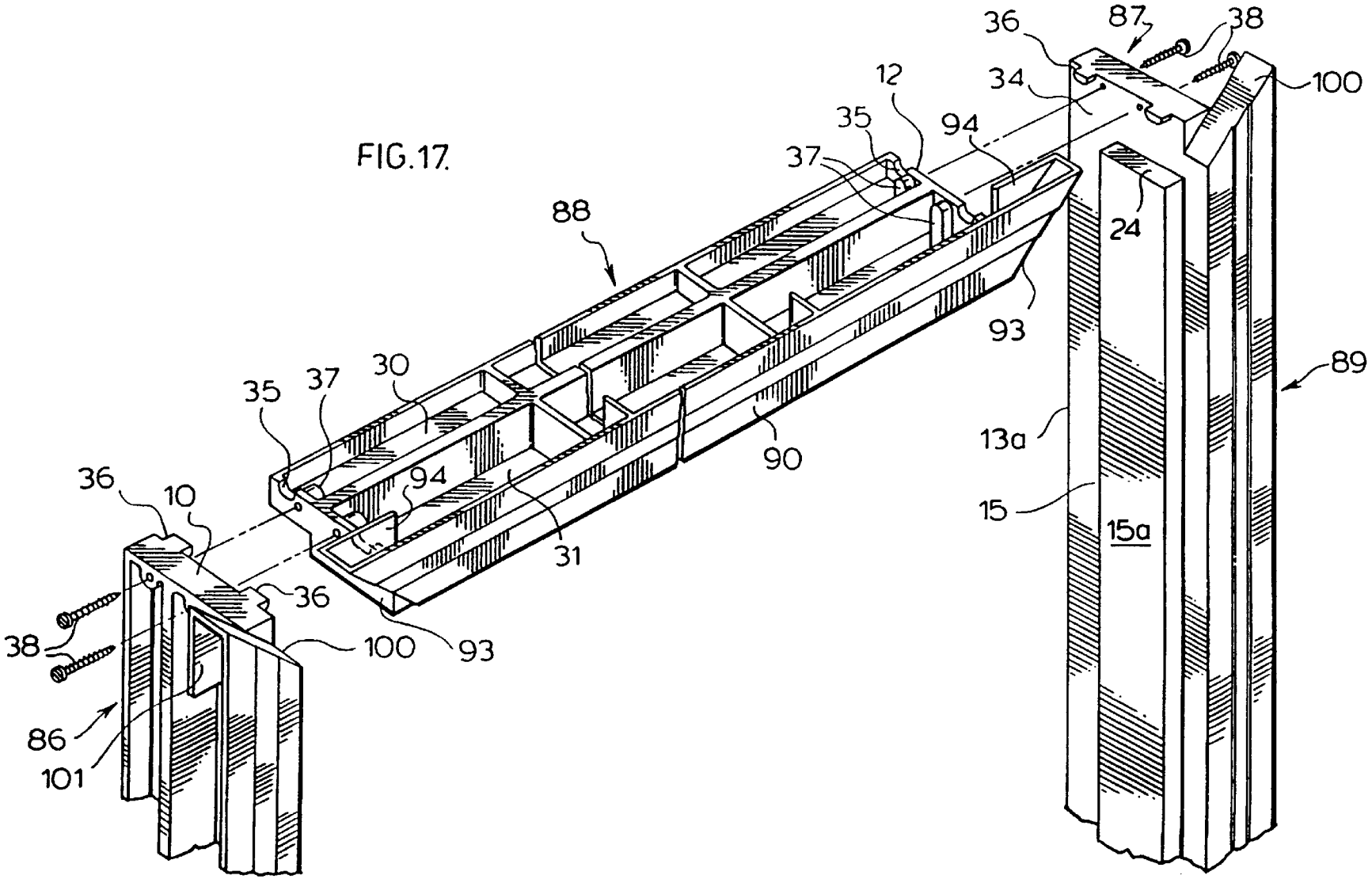
FIG. 17 is a perspective view illustrating the assembly of the header with the integral trim or brick molding with the tops of the jambs which have the integral trim or brick molding.
Figure 18:
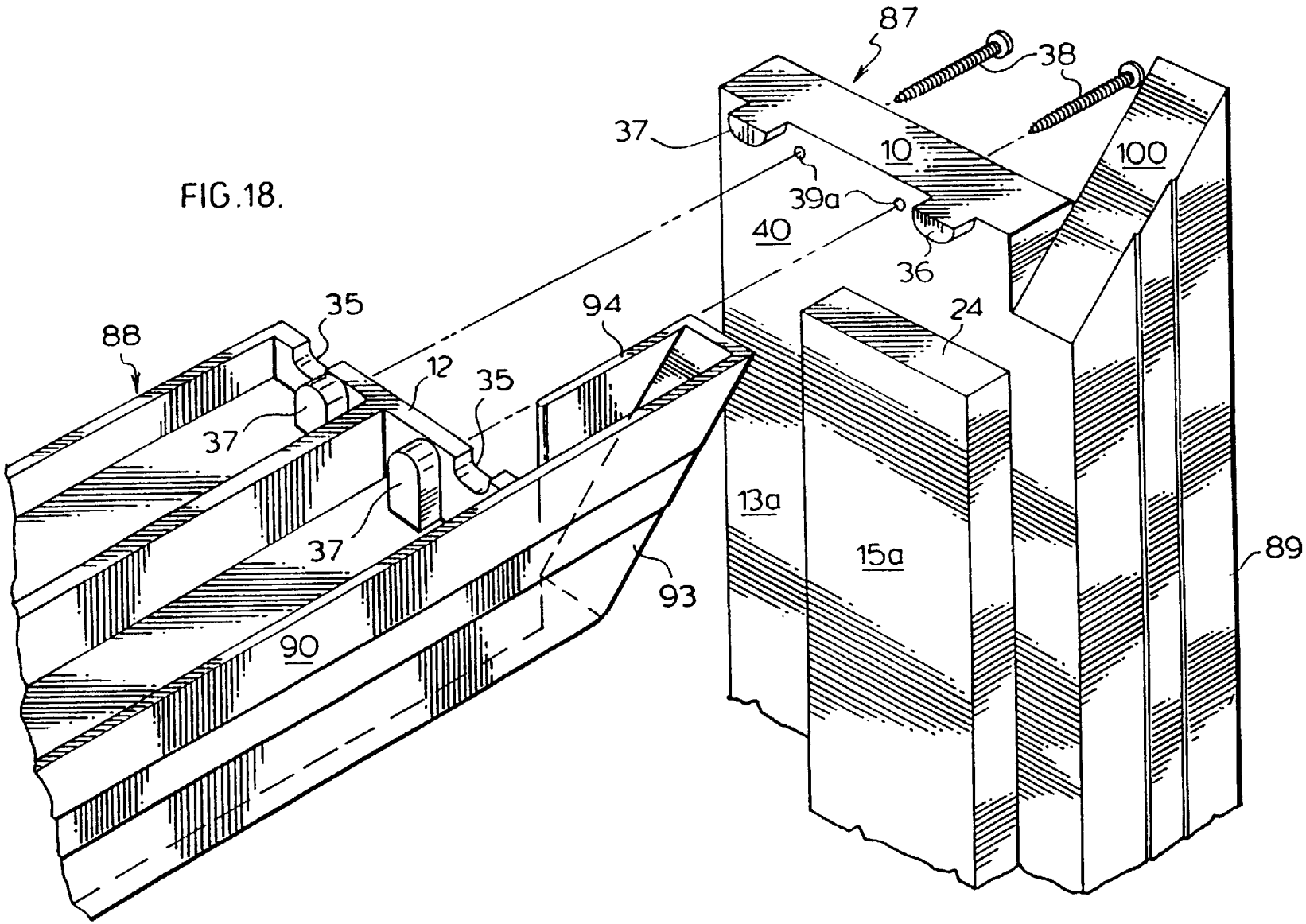
FIG. 18 is an enlarged perspective view illustrating the connection between one of the jambs illustrated in FIG. 17 and one end of the mating header.
Figure 22:
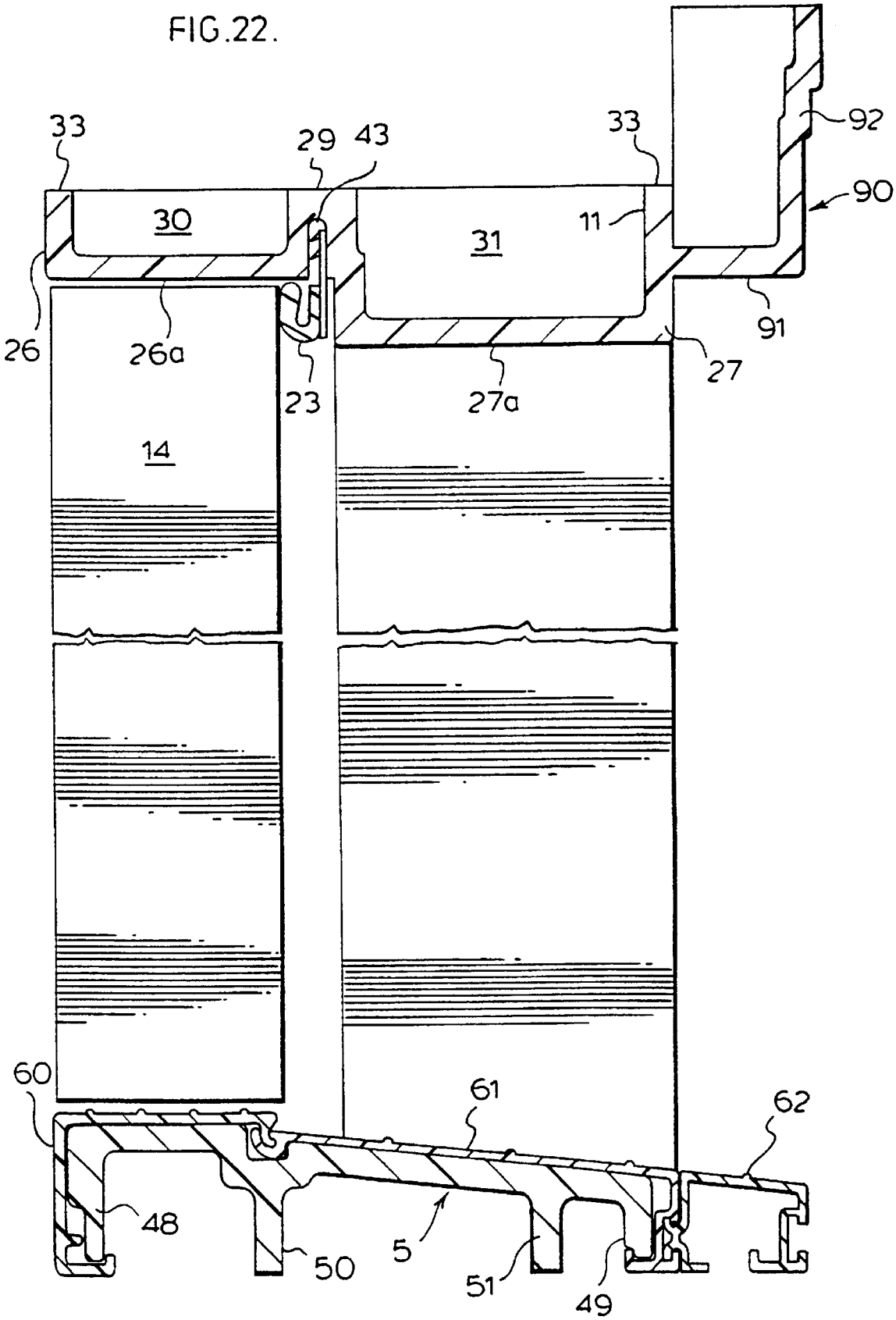
FIG. 22 is a vertical sectional view of the door frame assembly of FIG. 21.

As shown in FIGS. 17 and 18 and particularly in FIG. 22, the integral header molding 90 in the case of an in swing door, which represents the major portion of the market, extends outwardly from the header side wall 11 at a point spaced above the planar header wall 15 as shown in FIG. 22. The header molding 90 is, in effect, an elongated L-shaped section having a short leg portion 91 extending outwardly perpendicular to the header wall 11 at a point retracted from the planar surface 27*a* and a longer leg portion 92 extending at right angles thereto which forms the front wall of the header molding projecting outwardly of the opening defined by the door frame as shown in FIG. 22.

As shown in FIGS. 17 and 18, the ends of the header molding 90 are closed with a sloping wall 93 and a short return wall 94 to provide bevelled mounting surfaces for engagement with the jamb moldings 89 to provide mitered corners when the header 88 is assembled with the jambs 86 and 87 as described below.

Figure 21:
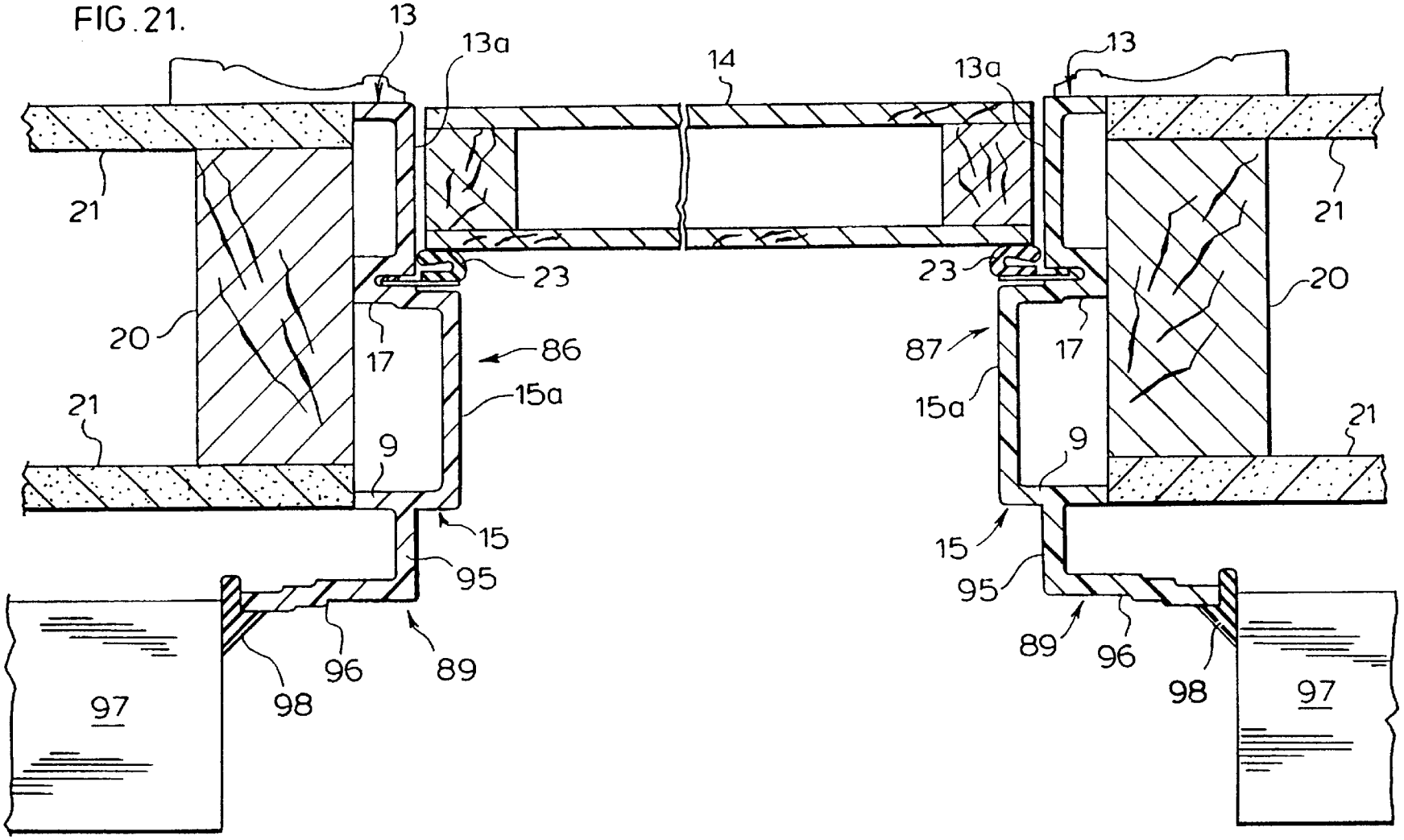
FIG. 21 is a horizontal sectional view showing the door frame with its integral trim or brick molding mounted in the door receiving opening with a door in the closed position.

As shown particularly in FIG. 21, as in the case of the header molding 90, each of the jamb moldings 89 is an elongated generally L-shaped formation having a short leg 95 projecting outwardly at right angles from the wall 9 of the jambs at a point retracted from the jamb planar surfaces 15*a* and a longer leg portion 96 projecting outwardly from the opening defined by the door frame.

FIG. 21 illustrates the function of the integral jamb moldings 89 which not only provide a trim appearance to the door frame but extend to meet with the brick work indicated at 97 (and hence termed brick moldings) to which they are sealed by caulking 98 to provide an air space 99 between the building wall structure constituted by the two by fours 20 and wall partitions 21 to provide an insulating effect.

It will be understood that a similar function will be formed by the header molding 90.

As shown in FIGS. 17 and 18, the upper ends of the jamb moldings 89 are closed by a sloping wall 100 and a short return wall 101. The bottoms of the jamb moldings 89 are provided with inturned feet 102 as shown in FIG. 19.

Figure 19:
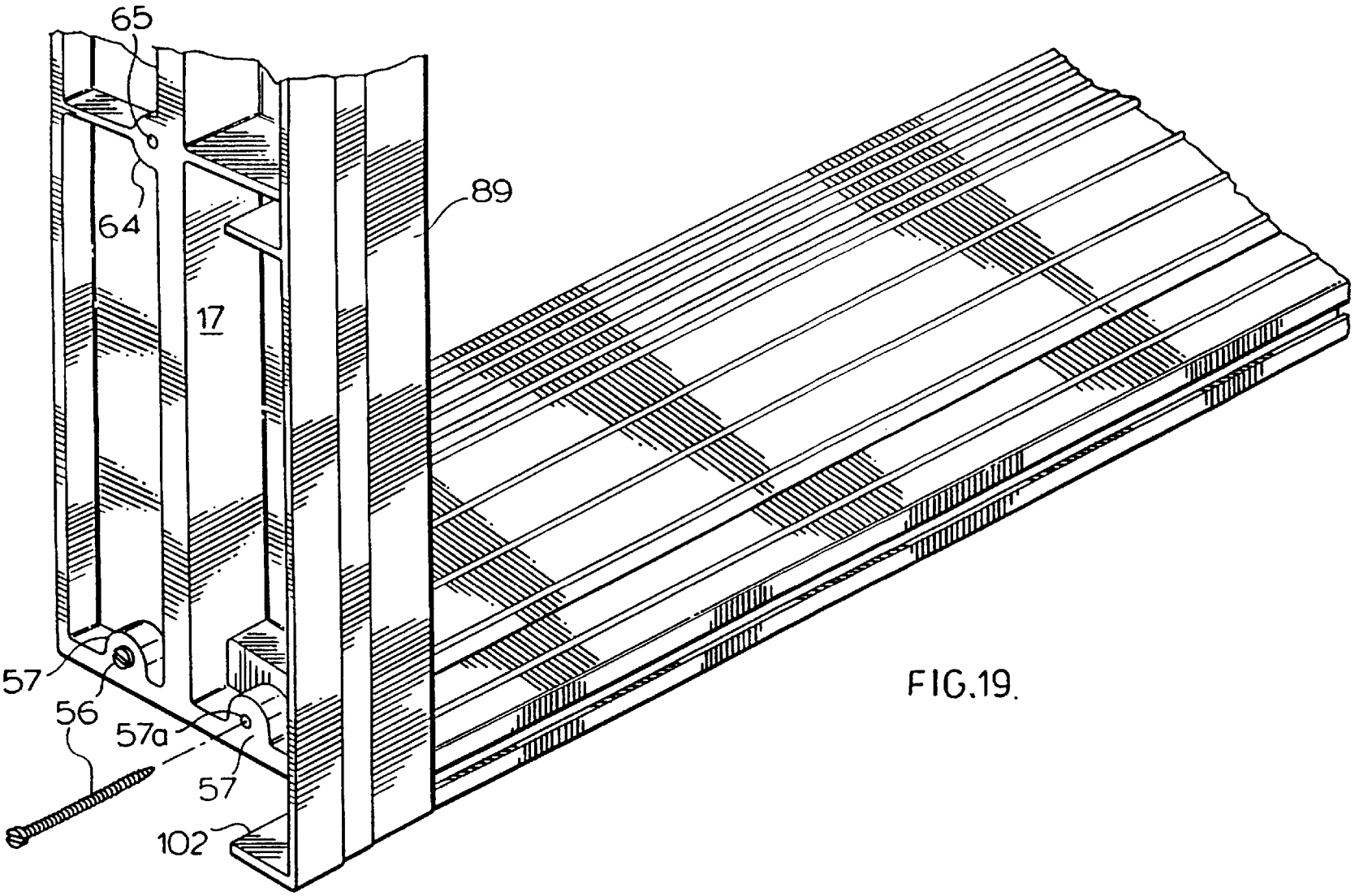
FIG. 19 is a perspective view illustrating the manner of connecting the bottom of the left hand jamb to the sill for an in swing door.
Figure 20:
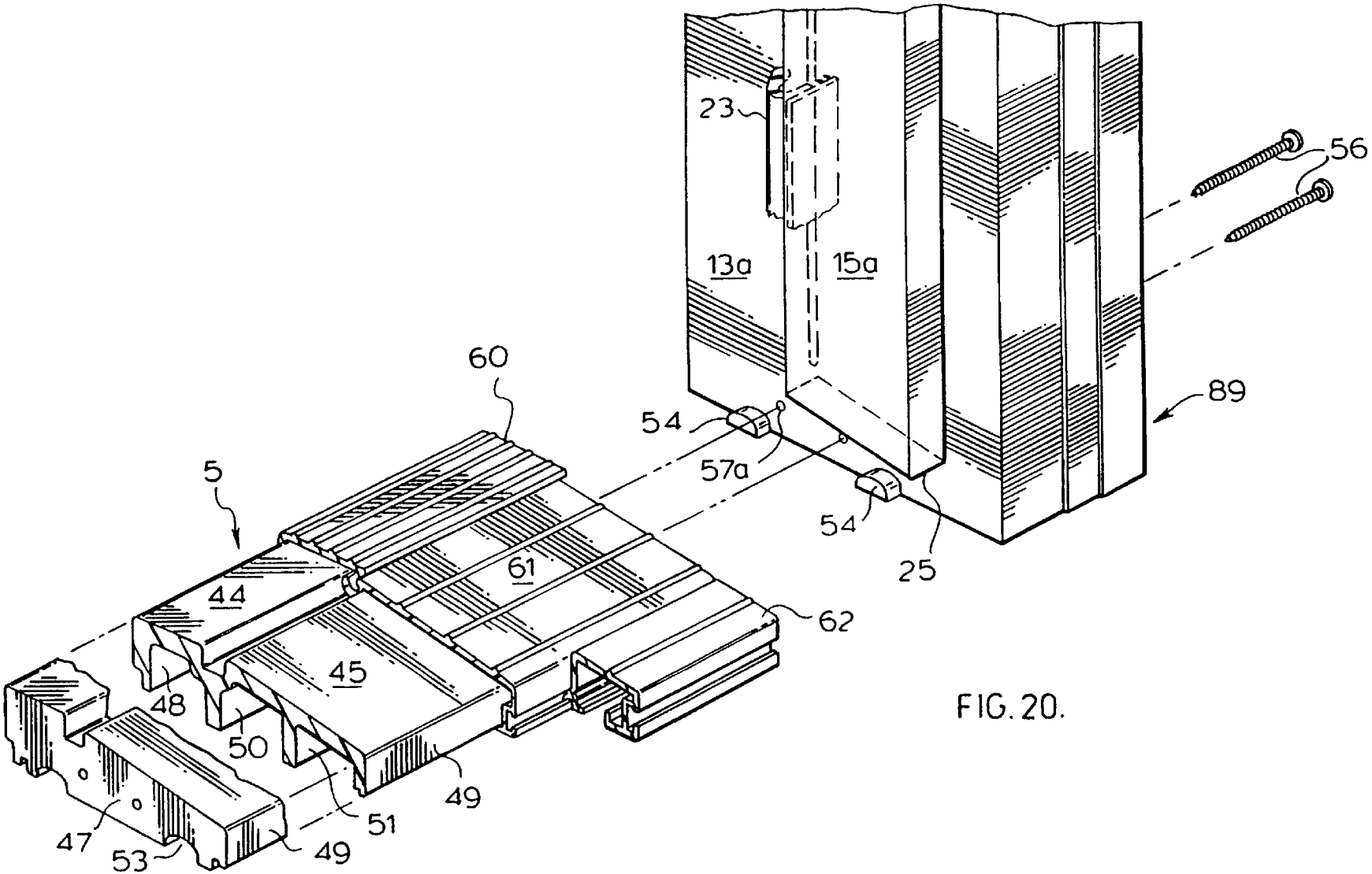
FIG. 20 illustrates the right hand jamb about to be attached to the other end of the sill.
Figure 23:
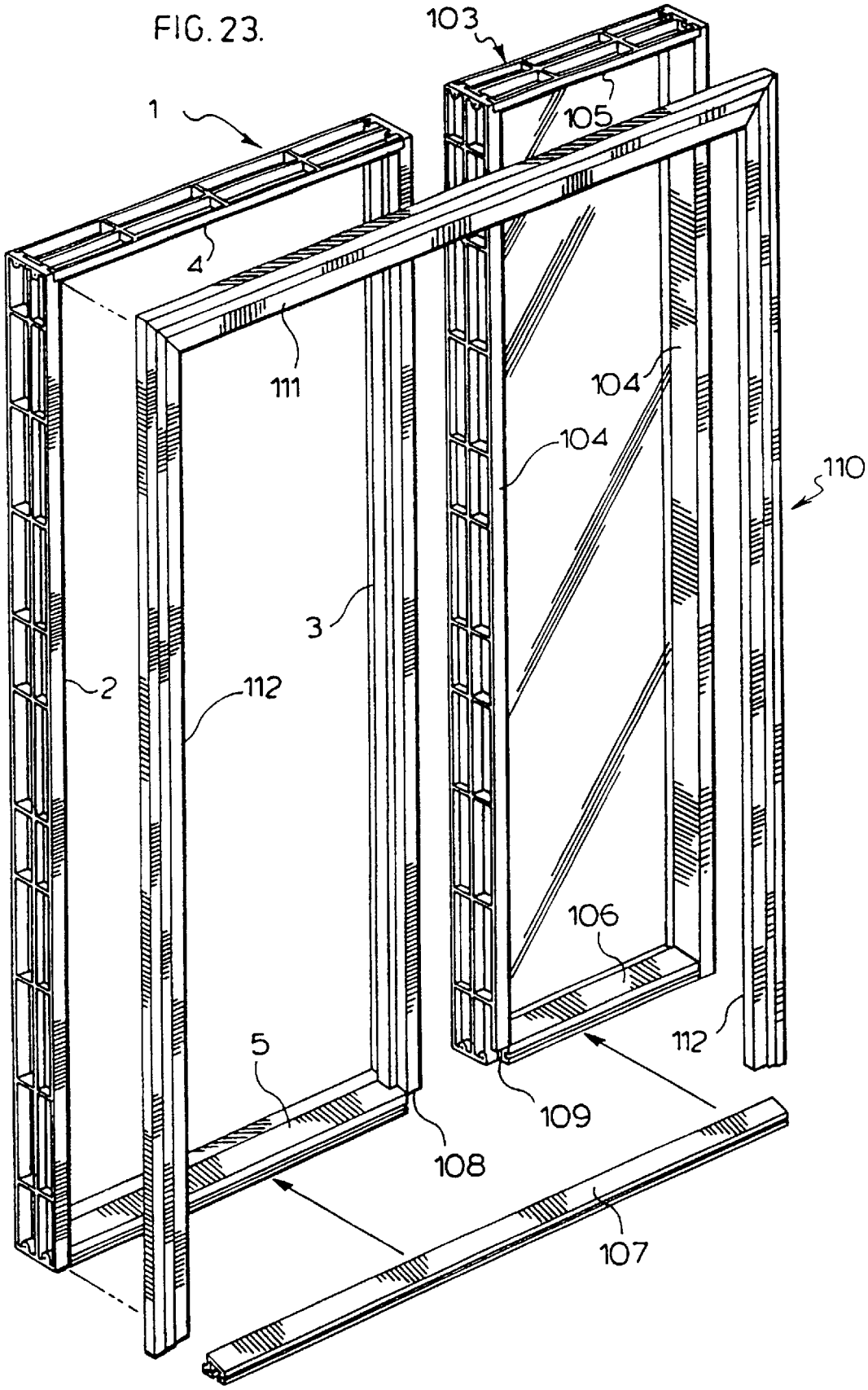
FIG. 23 is a perspective view illustrating a door frame and a side light frame ready for attachment with a separate trim or brick molding.
Figure 24:
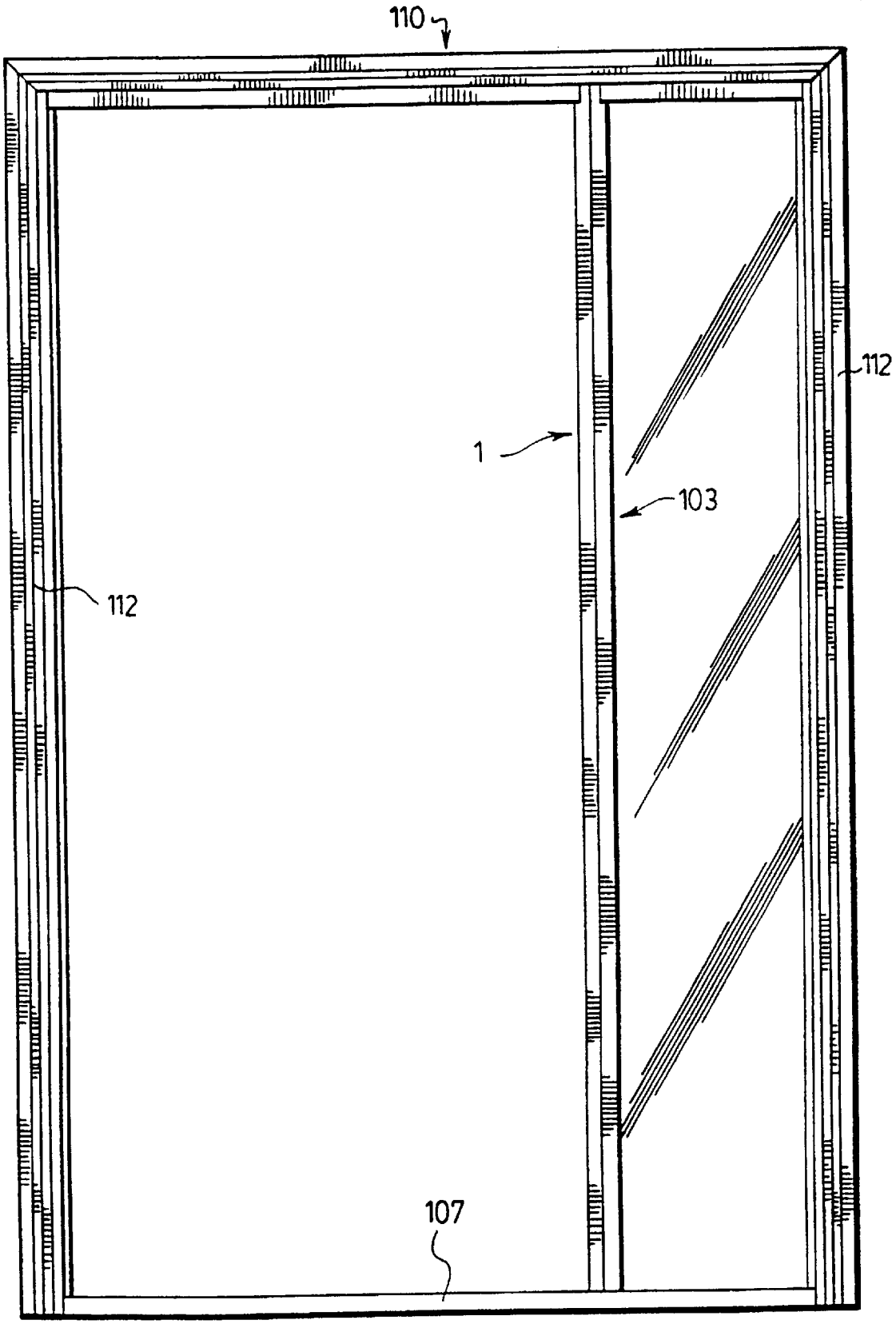
FIG. 24 is an elevational view showing the door frame and separate side light frame assembled with the peripheral molding attached.

The assembly of the jambs 86 and 87 with their integrally molded moldings 89 with the sill 5 is identical to that as described in connection with the jambs 2 and 3 and the sill 5 as illustrated in FIGS. 19 and 20, In many instances, the installation of a door frame may call for the provision of a side light at one side or even a side light at both sides. FIGS. 23 and 24 illustrate an installation involving a side light frame generally designated at 103 to be attached to the frame 1. It will be understood that this side light frame 103 is adapted to receive a conventional dual pane window unit (not shown) which has a thickness corresponding to the thickness of a door in the same manner that frame 1 is adapted to receive a door. The side light frame 103 is formed of jambs 104, header 105, and sill 106 which correspond to jambs 2 and 3 and to the header 4 and sill 5 respectively except that the jambs do not have provisions for the mounting of the hinges and reception of the door hardware and the internal pods involved with such hardware but as will be understood have appropriate internal pods (not shown) for assembling with the frame 1 and for mounting in the wall opening to receive same. The header 105 is provided by cutting a header corresponding to header 4 at an appropriate interior wall 12' (see FIG. 2) according to the width of the side light. The sill 106 is provided by cutting a sill corresponding to sill 5 FIG. 6 at an appropriate interior wall, eg. 47*a,* according to the width of the side light.

After the frames 1 and 103 are secured together in abutting relation the combined frames are given an integrated look by adding an aluminum profile piece 107 corresponding to the member 62 shown in FIG. 20 which extends the length of the combined frames. To accommodate this continuous profile piece 107 bridging across the combined frames, the forward edges of the adjoining bottoms of these frames are notched at 108 and 109 respectively. It will be understood that, if desired, the sills 5 and 106 could also be made as a continuous piece with appropriate notching of the rearward edges of the bottoms of the abutting frame jambs.

Figure 7A:
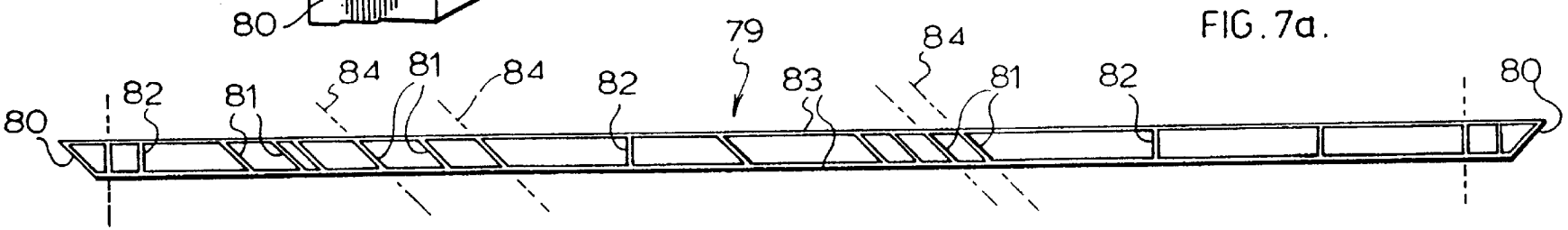
FIG. 7*a* is an elevational view looking into the bottom molding of FIG. 7 which has been placed on its side.

After assembling frames 1 and 103, a separate frame molding 110 is then applied with the header 111 and jambs 112 being cut from the elongated molding shown in FIGS. 7 and 7*a* at the appropriate lengths.

It will be understood that the door frame assembly may, if desired, also include a transom frame using a header 4 and short jambs involving the basic structure of the jambs 2 and 3.

While the preferred embodiments of the structure of composite compression molding frames and components according to the invention have been described, it will be understood that variations in the structural details of these frames and components may be made and they may be compression molded from a very wide range of composite materials comprising particulate materials bonded together by a thermoplastic binder all within the scope of the appended claims.

The embodiments of the invention in which an exclusive property or privilege is claimed are defined as follows:

1. A door frame assembly comprising a pair of molded jambs and a molded header formed of composite material, characterized in that each of said jambs and said header comprises first and second adjoining parallel longitudinal C-shaped channels defined by side walls one of which is a central side wall common to said adjoining channels, said channels being formed with bottoms and closed ends, the bottoms of the second channels projecting inwardly beyond and being parallel to the bottoms of the first channels such that the bottoms of the first channels of the jambs are dimensioned such that door hardware can be mounted thereto and the bottoms of the first channels on the jambs and header define a door receiving opening with the second channels presenting a door stop shoulder around said door receiving opening.

2. A door frame assembly as claimed in claim 1 characterized in that the bottoms presented by said second channels of said jambs that project beyond the bottoms of said first channels end short of the upper ends of said jambs and form support ledges for said header.

3. A door frame assembly as claimed in claim 2 characterized in that it further includes a sill of molded composite material having a longitudinal channeled formation closed at the ends.

4. A door frame assembly as claimed in claim 3 characterized in that the bottoms presented by said second channels of said jambs that project beyond the bottoms of said first channels end short of the lower ends of said jambs and form ledges for seating said jambs on said sill.

5. A door frame assembly as claimed in claim 1 or 2 characterized in that said side wall which is a side wall common to said channels of said jambs and header is formed with a weather strip receiving slot therein opening to the bottom of said channels.

6. A door frame assembly as claimed in claims 1 or 2 characterized in that each of said jambs and header members is formed with an integral molding at one face thereof presented as an exterior frame face when assembled to define a door receiving opening, each said integral molding comprising a L-shaped leg having a short laterally extending leg portion extending perpendicular to its respective exterior frame face at a point displaced outwardly from said door receiving opening and a longer outwardly extending leg portion extending outwardly of said door receiving opening and perpendicular to said short leg.

7. A door frame assembly as claimed claims 1 or 2 characterized in that said jambs and headers are formed to provide interengaging formations for orienting same in proper relative position preparatory to securing same together.

8. A door frame assembly as claimed in claims 1 or 2 characterized in that the interior of at least said first channel of each of said jambs and header is formed with an arrangement of integral thickened areas adapted to receive and support fasteners introduced therethrough.

9. A door frame assembly as claimed in any one of claims 1 or 2 characterized in that said first channels of said jambs and headers are formed with interior pods adjacent their common walls, said pods having holes therethrough for the passage of fasteners therethrough to secure said jambs and header to a door frame receiving opening.

10. A door frame assembly as claimed claim 1 characterized in that said composite material comprises filler, waste, or recycled particulate material bound together by a thermoplastic binder.

11. A door frame assembly as claimed in claim 10 characterized in that said thermoplastic binder is a recycled thermoplastic.

12. A door frame jamb molded of composite material characterized in that said jamb is formed with first and second adjoining parallel longitudinal C-shaped channels having side walls one of which is a central side wall common to said adjoining channels, all of said side walls having coplanar edges, each channel having a bottom and closed ends, the bottom of the second channel projecting beyond the bottom of said first channel and parallel thereto, said bottom of said first channel being dimensioned such that door hardware can be mounted within sid first and the second channel forming a door stop shoulder adjacent the bottom of said first channel.

13. A jamb as claimed in claim 12 characterized in that the presented bottom of said second channel which projects beyond the bottom of said first channel stops short of the top of said jamb to provide a support ledge.

14. A jamb as claimed in claims 12 or 13 characterized in that the presented bottom of said second channel which projects beyond the bottom of said first channel stops short of the bottom of said jamb to provide a seating ledge.

15. A jamb as claimed in claim 12 characterized in that said side wall which is a side wall common to said channels has a weather strip groove therein opening to the bottoms of said channels.

16. A jamb as claimed claim 12 characterized in that the bottom of said first channel has a row of screw head receiving recesses adjacent to said door stop shoulder.

17. A jamb as claimed in claim 12 characterized in that said jamb is provided with header registering means adjacent the top thereof and sill registering means adjacent the bottom thereof.

18. A jamb as claimed in claim 12 characterized in that it has an L-shaped molding formed integral therewith.

19. A jamb as claimed in claim 12 characterized in that the interior of at least said first channel is formed with an arrangement of integral thickened areas adapted to receive and support fasteners introduced therethrough.

20. A jamb as claimed in claim 12 characterized in that the bottom of said first channel is formed with hinge receiving recesses and the interior of said first channel opposite said hinge receiving recesses is formed with a pattern of integral interior pods to receive fasteners for securing hinges received in said recesses.

21. A jamb as claimed in claim 12 characterized in that the bottom of said first channel is formed with recesses to receive a striker plate and door latching hardware and the interior of said first channel has an arrangement of integral internal blocks of material opposite said recesses to receive fasteners to attach said striker plate and door latching hardware.

22. A jamb as claimed in claim 12 characterized in that said composite material comprises filler, waste, or recycled particulate material bound together by a thermoplastic binder.

23. A door jamb as claimed in claim 22 characterized in that said thermoplastic binder is a recycled thermoplastic.

24. A header for a door frame of molded composite material characterized in that said header is formed with first and second adjoining parallel longitudinal C-shaped channels having side walls one of which is a central side wall common to said adjoining channels, said channels being closed at their ends, each channel having a bottom with the bottom of said second channel being parallel to and projecting beyond the bottom of said first channel such that said second channel forms a door shoulder stop relative to the bottom of the first channel.

25. A header as claimed in claim 24 characterized in that said side wall which is a side wall common to said adjoining channels has a weather strip receiving groove therein opening to the bottom of said channels.

26. A header as claimed in claim 24 characterized in that it further has a trim molding formed integral with one of said side walls which is an outer side wall of the first channel.

27. A header as claimed in claims 24 characterized in that said composite material comprises filler, waste or recycled particulate material bound together by a thermoplastic binder.

28. A header as claimed in claim 27 characterized in that said thermoplastic binder is a recycled thermoplastic.

* * * * *